US010533821B2

(12) United States Patent
Chia

(10) Patent No.: US 10,533,821 B2
(45) Date of Patent: Jan. 14, 2020

(54) TOY PROJECTILE LAUNCHER AND METHOD OF USING SAME

(71) Applicant: Easebon Services Limited, Kwun Tong (HK)

(72) Inventor: Francis See Chong Chia, Kowloon (HK)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 16/007,660

(22) Filed: Jun. 13, 2018

(65) Prior Publication Data

US 2019/0383575 A1 Dec. 19, 2019

(51) Int. Cl.

| | |
|---|---|
| ***F41B 4/00*** | (2006.01) |
| ***F41B 7/08*** | (2006.01) |
| ***A63F 9/02*** | (2006.01) |
| ***F41B 11/54*** | (2013.01) |

(52) U.S. Cl.

CPC ..... *F41B 4/00* (2013.01); *A63F 9/0252* (2013.01); *A63F 9/0278* (2013.01); *F41B 7/08* (2013.01); *F41B 11/54* (2013.01); *A63F 2009/0282* (2013.01)

(58) Field of Classification Search

CPC ..... A63B 69/406; F41B 4/00; F41B 11/54

See application file for complete search history.

(56) References Cited

U.S. PATENT DOCUMENTS

| | | | |
|---|---|---|---|
| 5,709,199 | A | 1/1998 | Johnson et al. |
| 5,724,955 | A | 3/1998 | Johnson et al. |
| 5,988,152 | A | 11/1999 | Halter et al. |
| 6,076,511 | A | 6/2000 | Grimm et al. |
| 6,439,216 | B1 | 8/2002 | Johnson et al. |
| 8,127,754 | B1 | 3/2012 | Johnson et al. |
| 8,186,337 | B2 | 5/2012 | Nadel |
| 8,353,277 | B2 | 1/2013 | Huebl |
| 8,402,958 | B2 | 3/2013 | Victor et al. |
| 8,695,579 | B2 | 4/2014 | Huebl |
| 9,027,541 | B2 | 5/2015 | Huebl |

(Continued)

OTHER PUBLICATIONS

Nerf, Nerf Doomlands the Judge, Amazon.com, https://www.amazon.com/Nerf-B8571-Doomlands-The-Judge/dp/B01MYEXN9T/ (accessed Feb. 12, 2018) (9 pp).

(Continued)

*Primary Examiner* — John A Ricci

(74) *Attorney, Agent, or Firm* — Amster, Rothstein & Ebenstein LLP

(57) ABSTRACT

A toy launcher for toy projectiles includes a drum having two concentric rings of holders with an angular offset between adjacent concentric rings, and motorized flywheels to launch the projectiles. The launcher also includes an assembly for pushing projectiles in the drum toward the flywheels for launch, including a separate pushing rod for each of the concentric rings to advance one projectile at a time toward the flywheels. Both pushing rods are simultaneously pushed when a trigger is pressed, but only one projectile at a time is launched because while one pushing rod advances a projectile, the other pushing rod is blocked by a structure on the drum. Successive presses of the trigger cause projectiles to be launched in an alternating sequence in which one projectile at a time is launched first from a first concentric ring, then from a second concentric ring, then from the first concentric ring.

24 Claims, 26 Drawing Sheets

(56) References Cited

U.S. PATENT DOCUMENTS

| | | | |
|---|---|---|---|
| 9,097,476 | B2 | 8/2015 | Mead et al. |
| 9,513,075 | B2 | 12/2016 | Lallier et al. |
| 9,726,446 | B2 | 8/2017 | Wong et al. |
| 2002/0166551 | A1 | 11/2002 | Lee |

OTHER PUBLICATIONS

Mege, Nerf N-Strike MEGA Mastodon Blaster with 24 dart drum and 72 MEGA Whistler Darts 100 ft Shooting Distance by Mege, Amazon.com, https://www.amazon.com/N-Strike-Mastodon-Whistler-Shooting-Mege/dp/B01M8KGXDO (accessed Feb. 12, 2018) (6 pp).

Dart Zone Covert Ops, Dart Zone Magnum Superdrum Blaster, primetimetoys.com, https://www.primetimetoys.com/toys/dart-zone-magnum-superdrum-blaster/ (accessed Jun. 22, 2018) (2 pp).

Dartstorm Motorized Belt Blaster (2018) Dart Zone & Prime Time Toys, https://dartzoneblasters.com/shop/dart-zone-covert-ops/dartstorm-belt-blaster/ (accessed Feb. 12, 2018) (2 pp).

Buzz Bee Toys Automatic Tommy 20 Dart Blaster, Kmart.com, https://www.kmart.com/buzz-bee-toys-automatic-tommy-20-dart-blaster/p-004W548123110001P (accessed Jun. 22, 2018).

Buzz Bee Sidewinder Box, Blasterhub.com, https://www.blasterhub.com/buzz-bee-sidewinder-box/ (accessed Jun. 22, 2018) (3 pp).

X-Shot Turbo Advance Xcess Dart Blaster Shooter Playset—w/ Blaster, Darts and Accessories—100 Pieces, Amazon.com, (accessed Jun. 22, 2018) https://www.amazon.com/X-Shot-Advance-Blaster-Shooter-Playset/dp/B077BG25FL/ref=sr_1_1?ie=UTF8&qid=1529698109&sr=8-1&keywords=zuru+xshot+turbo+advance (6 pp).

Mattel—BOOMco Breakflip Blaster, amazon.com, https://www.amazon.com/BOOMCo-Breakflip-Exclusive-Metallic-Blaster/dp/B018G2405U/ (accessed Jun. 28, 2018) (7 pp).

X-Shot Turbo Advance Dart Blaster from Zuru, ttpm.com (accessed Jun. 27, 2018) https://ttpm.corn/p/24073/zuru/x-shot-turbo-advance-dart-blaster/ (1 page).

Review: Buzz Bee Double Drum (15m) | Blaster Hub (accessed Jun. 28, 2018) https://www.blasterhub.com/2017/09/review-buzz-bee-double-drum-15m/ (10 pp).

Adventure Force Af Decimator Dart Blaster—Walmart.com (accessed Jun. 28, 2018) https://www.walmart.com/ip/Adventure-Force-Af-Decimator-Dart-Blaster/209973333 (4 pp).

TOY PROJECTILE LAUNCHER AND METHOD OF USING SAME

FIELD

The present invention is generally related to a toy projectile launcher, such as a toy dart launcher, with a high capacity magazine.

BACKGROUND

Toy launchers that discharge soft projectiles, such as toy foam darts or toy foam balls—commonly referred to as toy "guns" or "shooters"—are well known in the art. The toy projectiles are designed to safely impact upon a target without causing injury or damage.

Toy launchers may use one of various different mechanisms for launching the projectiles. One common mechanism for launching toy projectiles from a toy launcher involves the application of compressed air on the projectiles to launch them. The compressed air must be carefully controlled so as to only be in fluid contact with the projectile or projectiles that are intended to be launched at a particular time. Another known mechanism to launch toy projectiles is to feed the toy projectiles to contact one or more rotating flywheels and thereby propel the projectiles forward toward a target.

Prior art launchers use one of a variety of different types of magazines for toy darts. For example, one type of magazine has a clip or cartridge for feeding darts to a barrel of the launcher. Another type of magazine holds the darts and advances the darts to firing position with a biasing spring when released upon activation of a trigger.

As another example, a straight magazine may hold darts in one or more rows of dart holders, with a possible offset between the rows. A straight magazine may, for example, be input horizontally into a compatible toy launcher and passes sideways through the launcher as darts are launched. Such a magazine has been used with a compatible compressed air toy launcher, but is not ideal as a magazine that moves sideways requires a clearance on either side of the launcher and must be reinserted each time that it is reloaded.

Another known type of magazine is a circular drum-style magazine.

One such prior art launcher, for example, includes a drum that has a single ring of toy dart holders arrayed around the drum. This launcher launches the darts with motorized flywheels positioned in front of the drum and darts are pushed one at a time from the drum to the flywheels for launch. A shortcoming of this launcher is that the number of darts that can fit in a single ring on a drum is limited in practice by the size of the launcher.

A different prior art launcher includes a drum having two concentric rings of darts where the concentric rings are aligned with one another and the toy darts are launched sequentially first from one ring and, after all of the darts in one ring are launched, then the darts in the other ring are launched. This launcher requires a switch between launching from one ring to another after one ring is fully depleted of darts and is inefficient as it requires two rotations of the drum to launch all of the darts.

Another prior art toy launcher uses a drum that has two concentric rings of dart holders with an offset between the rings. However, because compressed air is used to launch the darts, the number of darts that can be loaded in a drum of a particular size is very limited so that the air does not impact upon more than one dart and undesirably launch multiple darts at the same time.

What is needed is an improved toy launcher and a drum to be used therewith that may hold a relatively large number of toy darts within a compact space, be efficient in limiting the number of rotations of the drum that are necessary to launch a specific number of darts, and allow the launching of the toy darts in quick succession, while at the same time maintaining a relatively modest form factor, which is useful to enable for children to be able to handle the toy launcher and is helpful for shipping and storage of the launcher. It is further desirable that such a toy launcher be manufactured without the use of compressed air, which, as noted above, would limit the number of darts that can be simultaneously stored in the drum, and which may increase the complexity of the toy launcher to ensure proper alignment of a nozzle and appropriate air pressures.

SUMMARY

The present invention is generally related to an improved toy launcher for launching projectiles, such as soft projectiles like toy darts or toy balls.

in accordance with an embodiment of the present invention, a toy launcher for launching projectiles includes a drum having a substantially circular shape and two or more concentric rings of projectile holders to hold projectiles for launching. The drum includes a first of the two or more concentric rings located substantially at a first radius from the center of the drum and a second of the two or more concentric rings located substantially at a second radius from the center of the drum, wherein the second radius is different than the first radius. Adjacent projectile holders within each of the first second concentric rings are each separated from one another by a respective divider, and respective projectile holders in the first concentric ring are angularly offset from the respective projectile holders in the second concentric ring. The toy launcher further includes one or more flywheels positioned in front of a first side of the drum that are adapted to propel at least one of the projectiles when pushed from the drum toward the one or more flywheels for launching the at least one of the projectiles out of the toy launcher.

In embodiments, the toy launcher further includes a projectile advancement assembly to push the projectiles from the projectile holders of the drum one at a time toward the one or more flywheels to launch the projectiles. The projectile advancement assembly includes a first pushing rod that is positioned so as to be aligned with the projectile holders in the first concentric ring and adapted to push at least one of the projectiles from the projectile holders of the first concentric ring and a second pushing rod that is positioned so as to be aligned with the second projectile holders in the second concentric ring and adapted to push at least one of the projectiles from the projectile holders of the second concentric ring. The projectile advancement assembly is adapted to substantially simultaneously push both the first and second pushing rods each time that the projectile advancement assembly is engaged.

In embodiments, the toy launcher further includes a trigger that, upon activation, causes an incremental rotation of the drum and engages the projectile advancement assembly to push the plurality of pushing rods forward substantially simultaneously toward the drum such that the first pushing rod that is in alignment with a respective one of the projectile holders in the first concentric ring is adapted to mechanically push a first of the projectiles, when loaded, in the respective one of the projectile holders to engage with at least one of the one or more flywheels to launch the first projectile. At the same time, the second pushing rod that is in alignment with the second concentric ring is blocked by the respective divider that separates the adjacent projectile holders in the second concentric ring from pushing a second of the projectiles substantially simultaneously with the launch of the first of the projectiles.

In embodiments, the first and second pushing rods are spring-loaded.

In embodiments, the projectile advancement assembly further includes a pinion gear that freely rotates about a fixed position, and each of the first and second pushing rods includes a respective rack that engages with the pinion gear so that a forward movement of one pushing rod of the first and second pushing rods causes a backward movement of the other pushing rod of the first and second pushing rods. In embodiments, the projectile advancement assembly is adapted such that a push of one of the first and second pushing rods into an aligned projectile holder in one of the first and second concentric rings of the drum causes the pinion gear to rotate and cause a force on the other of the first and second pushing rods to move backwards away from the drum.

In embodiments, the drum includes a second side with a plurality of openings to the projectile holders corresponding to each of the plurality of projectile holders in the first and second concentric rings. The plurality of openings are sized to allow a first of the plurality of pushing rods to fit through each the plurality of openings in the first concentric ring, and to allow a second of the plurality of pushing rods to fit through each of the plurality of openings in the second concentric ring.

In embodiments, the drum further includes, on the second side of the drum, a plurality of non-linear grooves with each groove corresponding to a different one of the plurality of projectile holders in each of the first and second concentric rings. The toy launcher further includes a pawl that is adapted to glide through each of the plurality of non-linear grooves to rotate the drum incrementally upon gliding through one of the plurality of non-linear grooves.

In embodiments, the projectile advancement assembly further includes a mounting plate or bracket coupled to the first and second pushing rods.

In embodiments, the projectiles are toy darts.

In embodiments, the projectiles are toy balls.

In embodiments, the drum is removable from the toy launcher. In embodiments, the drum is non-removable from the toy launcher.

In embodiments, the drum is rotatable within the toy launcher such that each of the projectile holders in both the first and second concentric rings is positionable to allow the projectiles to be launched one at a time in a sequence starting with a first launch of a first of the projectiles from a respective projectile holder in the first concentric ring, and then a second launch of a second of the projectiles from an adjacent one of the respective projectile holders in the second concentric ring.

In embodiments, at least one of the one or more flywheels are motorized and are positioned adjacent the drum so as to engage with the respective projectile when the respective projectile is pushed out of the drum.

In embodiments, the one or more flywheels include at least one elongated flywheel that extends in length adjacent both the first and second concentric rings of projectile holders.

In embodiments, the projectile holders are substantially equally spaced apart from one another In embodiments, the plurality of projectile holders are adapted to hold toy darts.

In embodiments, the projectile holders are of substantially equal dimensions.

In accordance with an embodiment of the present invention, a toy launcher for launching projectiles includes a drum having a substantially circular shape and including two or more concentric rings of projectile holders to hold projectiles for launching. The drum includes a first of the two or more concentric rings located substantially at a first radius from the center of the drum and a second of the two or more concentric rings located substantially at a second radius from the center of the drum, wherein the second radius is different than the first radius. Adjacent projectile holders within each of the first second concentric rings are each separated from one another by a respective divider.

The toy launcher further includes a projectile advancement assembly to push the projectiles from the projectile holders of the drum one at a time to launch the projectiles. The projectile advancement assembly has a first pushing rod that is positioned so as to be aligned with the projectile holders in the first concentric ring and adapted to push at least one of the projectiles from the projectile holders of the first concentric ring and a second pushing rod that is positioned so as to be aligned with the second projectile holders in the second concentric ring and adapted to push at least one of the projectiles from the projectile holders of the second concentric ring. The projectile advancement assembly is adapted to substantially simultaneously push both the first and second pushing rods each time that the projectile advancement assembly is engaged.

The toy launcher also includes a trigger that, upon activation, causes an incremental rotation of the drum and engages the projectile advancement assembly to push the plurality of pushing rods forward substantially simultaneously toward the drum such that the first pushing rod that is in alignment with a respective one of the projectile holders in the first concentric ring is adapted to mechanically push a first of the projectiles, when loaded, in the respective one of the projectile holders to launch the first projectile, while the second pushing rod that is in alignment with the second concentric ring is blocked by the respective divider that separates the adjacent projectile holders in the second concentric ring from pushing a second of the projectiles substantially simultaneously with the launch of the first of the projectiles.

In embodiments, the first and second pushing rods are spring-loaded.

In embodiments, the projectile advancement assembly further includes a pinion gear that freely rotates about a fixed position. Each of the first and second pushing rods includes a respective rack that engages with the pinion gear so that a forward movement of one pushing rod of the first and second pushing rods causes a backward movement of the other pushing rod of the first and second pushing rods. Further, in embodiments, the projectile advancement assembly is adapted such that a push of one of the first and second pushing rods into an aligned projectile holder in one of the first and second concentric rings of the drum causes the pinion gear to rotate and cause a force on the other of the first and second pushing rods to move backwards away from the drum.

In embodiments, the respective projectile holders in the first concentric ring are angularly offset from the respective projectile holders in the second concentric ring.

BRIEF DESCRIPTION OF THE DRAWINGS

Exemplary embodiments of the present invention will be described with references to the accompanying figures, wherein:

FIG. 12(*b*) shows an enlargement of a back portion of the toy dart launcher shown in FIG. 12(*a*);

FIG. 16(*b*) shows a cutaway view of the toy dart launcher in perspective where the trigger has been activated and the toy dart launched from the outer concentric ring has been propelled through the barrel of the launcher in accordance with an embodiment of the present invention;

FIG. 16(*c*) shows a cutaway view of the toy dart launcher in perspective where the toy dart launched in FIG. 16(*a*) is about to exit the barrel of the launcher in accordance with an embodiment of the present invention;

FIG. 17(*b*) shows a cutaway view of the toy dart launcher in perspective where the trigger has been activated in FIG. 17(*a*) and the toy dart launched from the inner concentric ring has been propelled through the barrel of the launcher in accordance with an embodiment of the present invention;

FIG. 18(*b*) shows a cutaway view of the toy dart launcher in accordance with the second embodiment where the toy dart has been propelled through the barrel of the launcher;

FIG. 18(*c*) shows a cutaway view of the toy dart launcher in perspective where the toy dart launched in FIG. 18(*a*) is about to exit the barrel of the launcher in accordance with the second embodiment of the present invention;

FIG. 19(*b*) shows a cutaway view of the toy dart launcher in perspective where the trigger has been activated in FIG. 19(*a*) and the toy dart launched from the inner concentric ring has been propelled through the barrel of the launcher in accordance with an embodiment of the present invention.

DETAILED DESCRIPTION

The present invention is generally related to an improved toy launcher with a drum for launching projectiles. To achieve a high capacity, the drum includes at least two concentric rings of projectile holders that are closely spaced together with an angular offset between projectile holders in adjacent concentric rings. In embodiments, the projectile holders are adapted to hold one or more types of projectiles, such as toy foam darts, foam balls, or other objects. Multiple pushing rods, one for each of the at least two concentric ring of projectile holders are simultaneously activated and advance toward a back of the drum to push the projectiles, one at a time, from the front of the drum toward one or more flywheels that propel each projectile out of the launcher and toward a target. In embodiments, the pushing rods are spring-loaded or piston-gear loaded, and the one or more flywheels may be motorized. The projectiles are launched in a sequence that alternates between a launch of a first projectile from a first concentric ring, then a launch of a second projectile from a second concentric ring, then a launch of a third projectile from the first concentric ring. Although both pushing rods are simultaneously pushed, due to the design of the drum, the toy launcher launches only one projectile at a time from a projectile holder on one concentric ring at a time. As is described in further detail below, this is because one of the pushing rods is blocked from launching a second projectile by the structure of the drum while the first projectile is launched.

Figure 1:
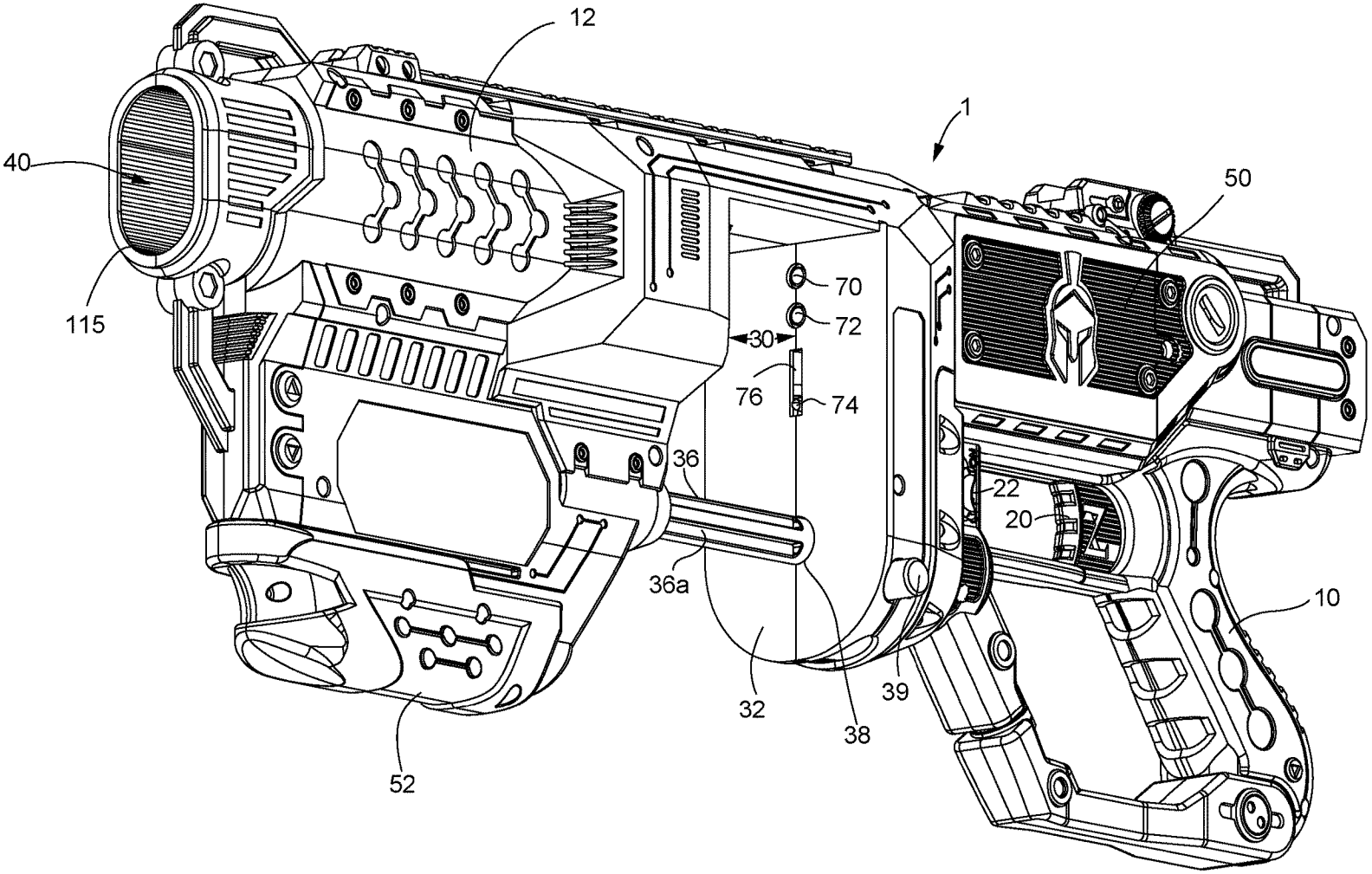
FIG. 1 is a first perspective view of a toy dart launcher, without the drum for holding the toy darts, in accordance with an embodiment of the present invention.
Figure 2:
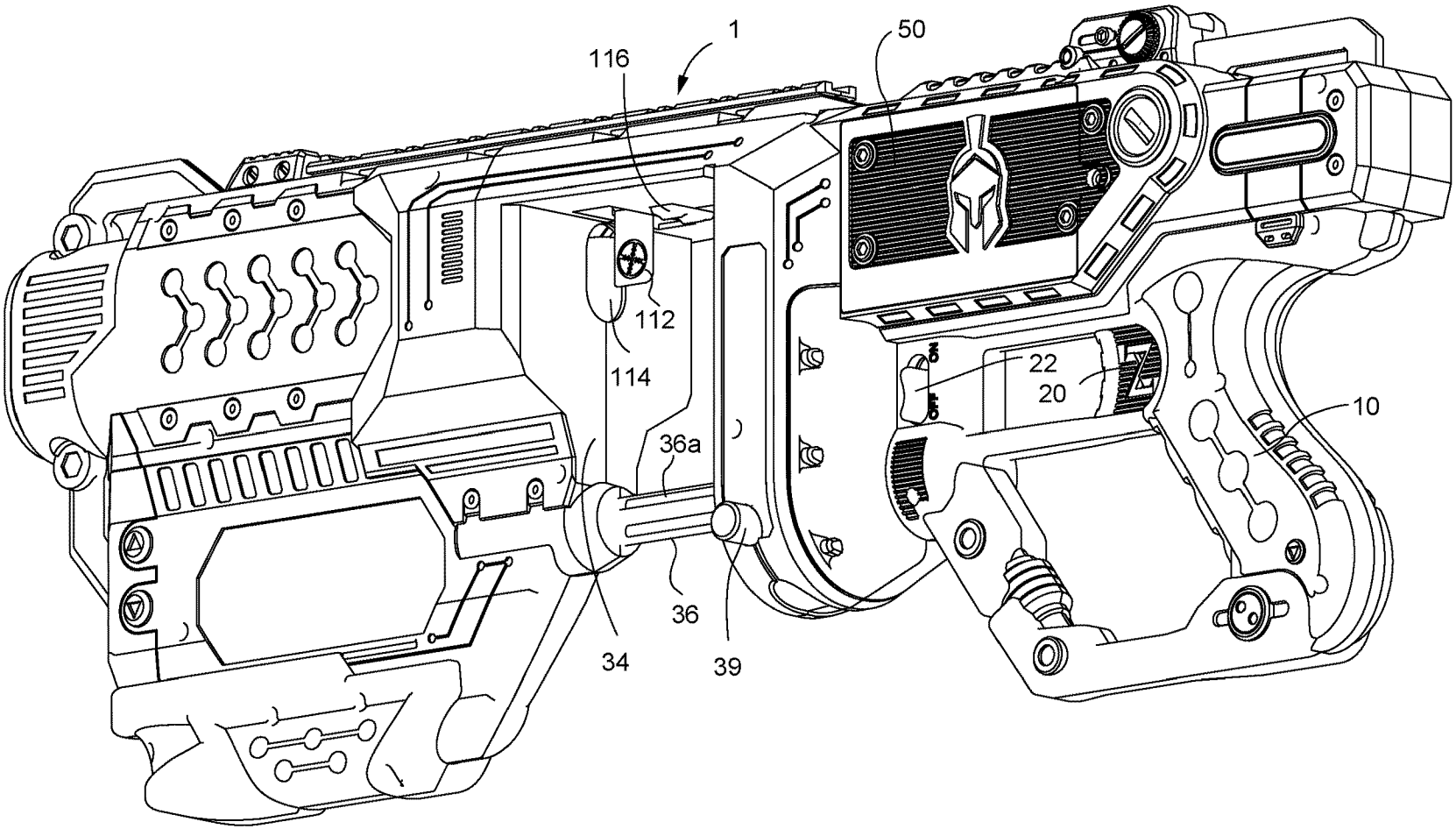
FIG. 2 is a second perspective view of the toy dart launcher shown in FIG. 1 from a different angle, in accordance with an embodiment of the present invention.

Referring to FIGS. 1 and 2, a launcher 1 for projectiles in accordance with an exemplary embodiment of the present invention includes a handle 10 for holding the back end of launcher 1, a front handle 52 for holding the front of launcher 1, a trigger 20 for launching projectiles, a designated space or recess 30 for accepting a magazine such as a substantially circular drum 60 (see FIG. 3) into which toy darts or other objects are to be loaded, a rod (shaft) 36 within recess 30 to hold drum 60, and a barrel 40 at the front of launcher 1 out of which the darts are propelled. Barrel 40 extends between an opening 114 in front wall 34 and a front opening 115 of launcher 1. Launcher 1 further includes a projectile advancement assembly having pushing rods 70, 72, and launcher 1 also includes flywheels 110*a*, 110*b* (FIGS. 12 and 13), a power supply, such as battery compartment 50 into which batteries may be placed to power launcher 1, and an on/off switch 22 to turn on and off the flywheels. Recess 30 is located between a back wall 32 and a front wall 34.

In embodiments, drum 60 may be non-removable from launcher 1. In other embodiments, drum 60 may be loadable and/or removable from launcher 1. Having a drum 60 as a separable component may be desirable for purposes such as for compact packaging and shipping of launcher 1, or replacing drum 60 as needed or desired (e.g., if broken or for use in launching a different type of projectile, to name a few) or to enable a user to carry a second loaded drum to increase the user's firepower.

Figure 12A:
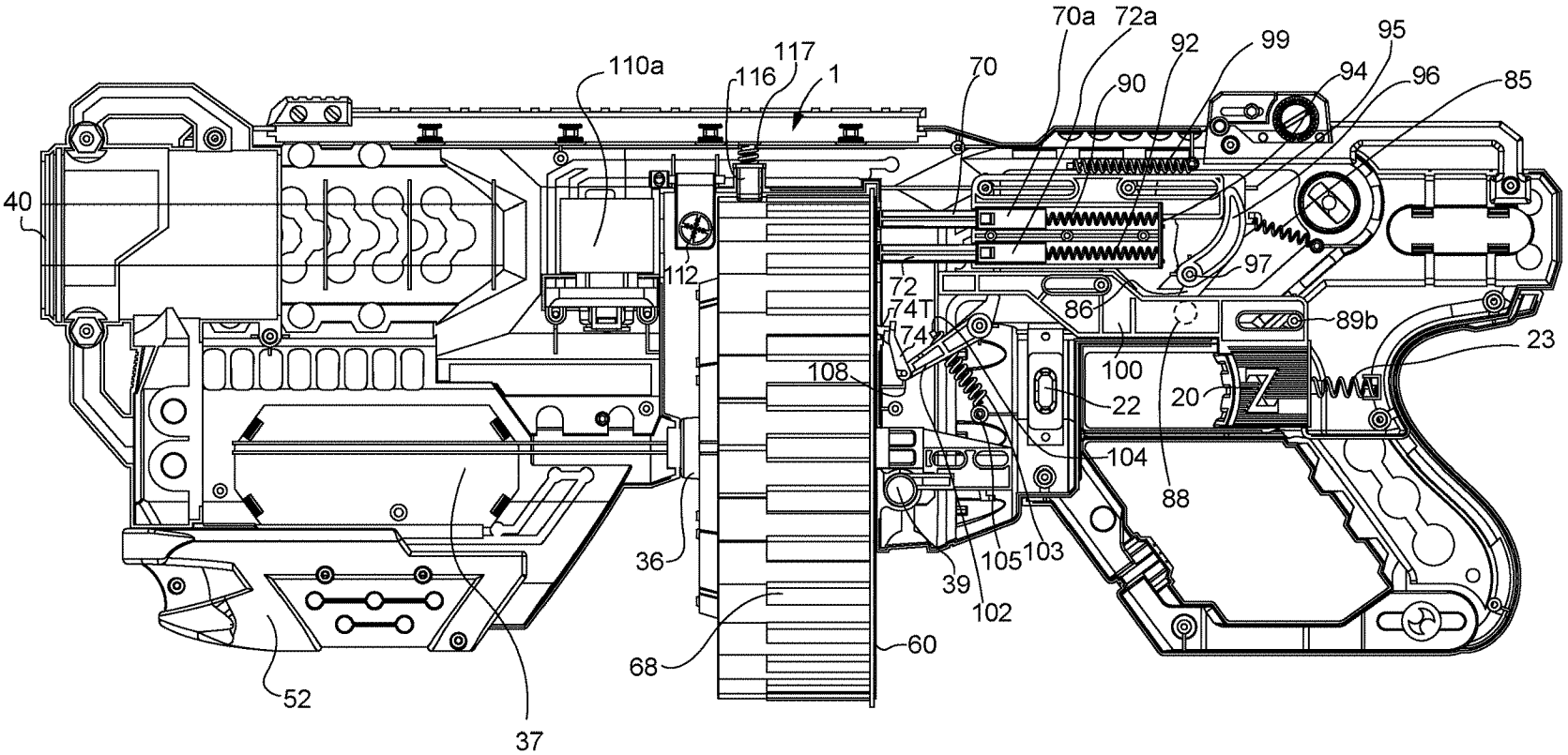
FIG. 12(*a*) shows a cutaway view of the right side of the toy dart launcher in accordance with an embodiment of the present invention.
Figure 12B:
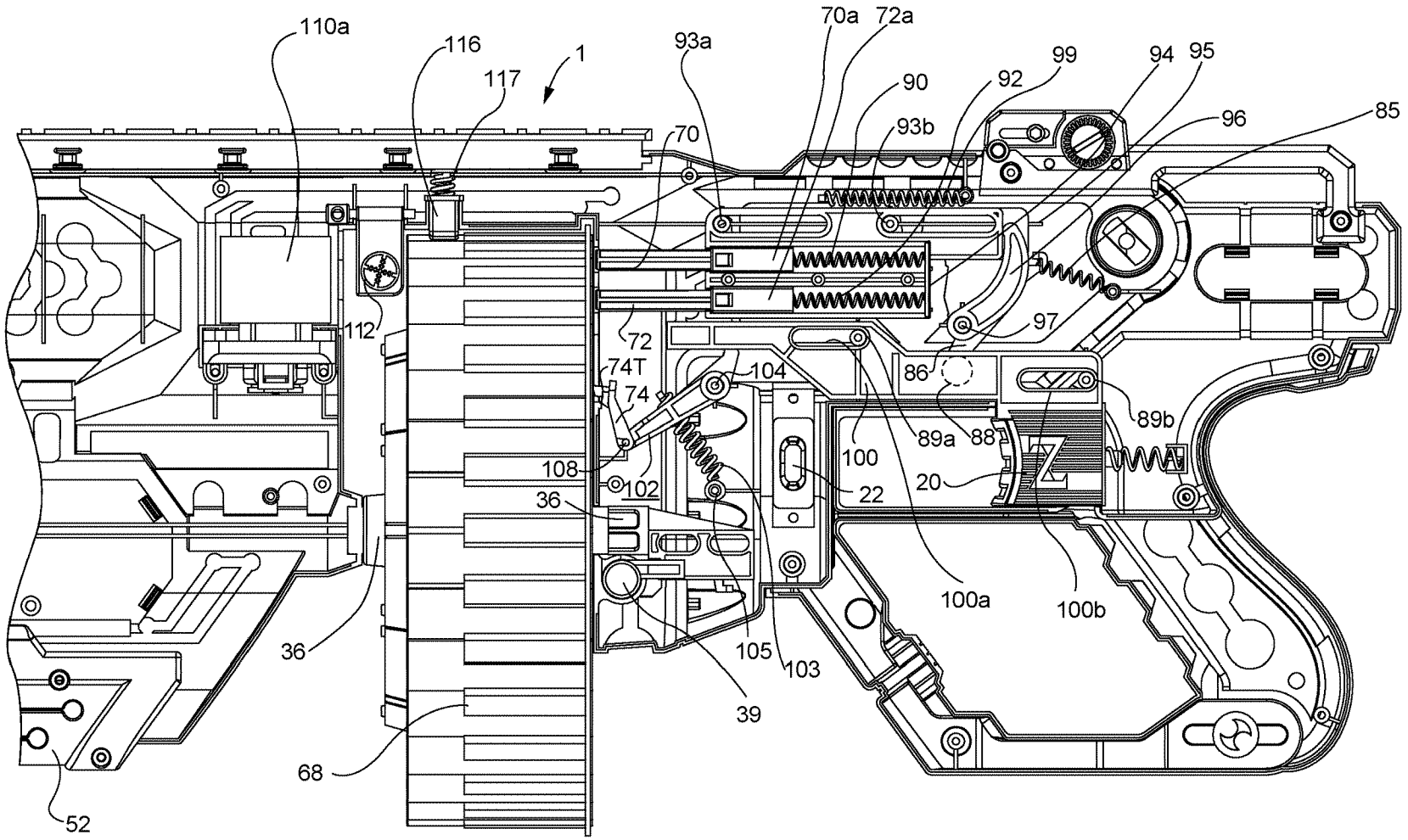

In embodiments in which drum 60 is loadable, such as for installation, rod 36 may be retracted to an open position with a retracting mechanism (such as for retracting rod 36 forward into an interior compartment 37 within outer shell 12 of launcher 1—FIG. 12(*a*)) so as to allow drum 60 to be loaded into launcher 1. Once drum 60 is loaded into launcher 1, rod 36 is returned to a closed position to retain drum 60. Drum 60 is rotatable about rod 36 for launching projectiles. In embodiments, rod 36 is secured in a closed position with a releasable lock or latch so that drum 60 is not accidentally released from launcher 1. Rod 36 may be retracted from the center of drum 60 to allow drum 60 to be removed. In embodiments, to retract rod 36 where it is secured with a lock or latch, a user first presses on a release button 39 to release the lock or latch.

In embodiments, rod 36 is generally circular in cross-section and has recesses 36*a* about the circumference of rod 36. In embodiments, a portion of rod 36 on which drum 60 is secured, such as the central portion, may have a larger radius than other portions of rod 36.

In the illustrated embodiment, drum 60 is configured to shoot toy darts. Darts may be loaded into drum 60 before drum 60 is loaded into launcher 1 and/or darts may be loaded and/or refilled in drum 60 after drum 60 is loaded into the launcher.

Figure 3:
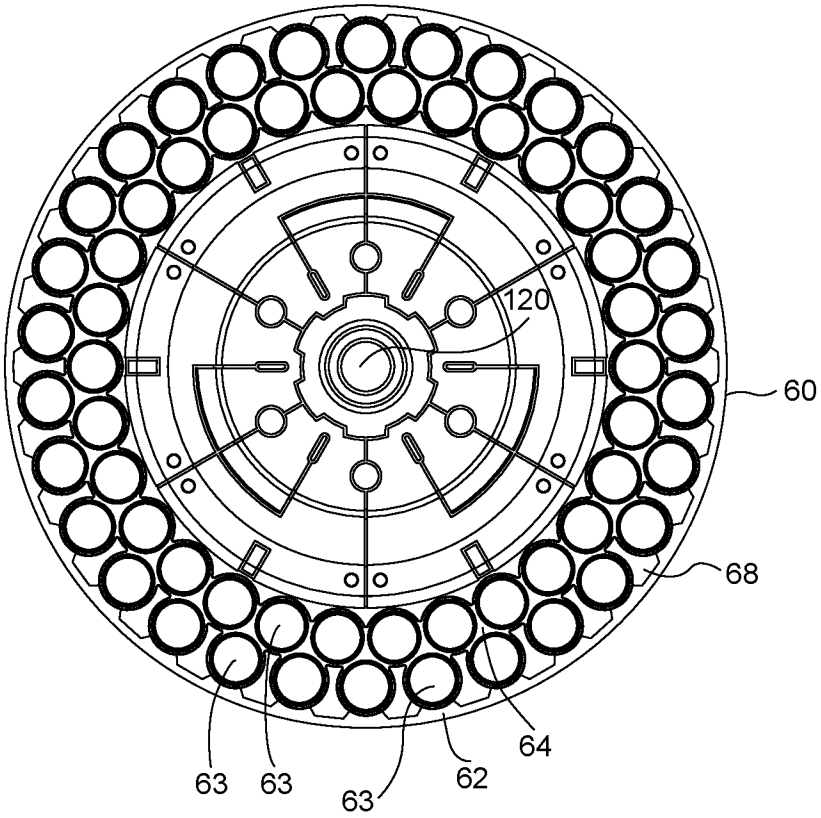
FIG. 3 is a front view of a drum for the toy launcher with toy darts loaded therein in accordance with an embodiment of the present invention.

FIG. 3 depicts a front view of a first, front side of an exemplary embodiment of drum 60 for use in launcher 1. Drum 60 includes at least the two concentric rings 62, 64 of projectile holders (or chambers) 61 spaced around the periphery of drum 60. A first of the concentric rings is located substantially at a first radius from the center of drum 60 and a second of the concentric rings is located substantially at a second radius from the center of the drum, where the second radius is different than the first radius. The projectile holders 61 are thus spaced in a staggered arrangement such that the projectile holders 61 in a first concentric ring 62 are offset in an angular direction from the projectile holders 61 in a second concentric ring 64 (i.e., the projectile holders 61 in a first concentric ring 62 are between the projectile holders 61 in the second concentric ring 64 and vice versa). Where only two concentric rings 62, 64 are provided, first concentric ring 62 may be referred to as the outer concentric ring, and second concentric ring 64 may be referred to as the inner concentric ring. The staggering of the projectile holders in one concentric ring with projectile holders in an adjacent concentric ring allows for a simplified launcher construction by enabling two pushing rods to be pushed simultaneously without having to separately control each pushing rod, or to move a single pushing rod or the drum up and down for proper alignment to launch a projectile.

As shown in FIG. 3, projectile holders 61 are adapted to hold the projectiles, such as toy foam darts, to be launched from launcher 1. In embodiments, projectile holder 61 within each of the inner and outer concentric rings 62, 64 are of substantially equal dimensions, are substantially-equally spaced apart from one another, and are spaced apart as little as possible to fit as many darts as possible in the drum at a time. In the illustrated embodiment, for example, there are sixty (60) projectile holders, although drum 60 may be alternatively configured to hold more or fewer darts. A center hole 120 allows for retractable rod 36 to pass therethrough and retain drum 60 in launcher 1. The area between center hole 120 and inner concentric ring 64 may be solid, as shown for example in FIG. 5, or may be have a different configuration to maintain the staggered concentric rings of projectile holders in the desired positions.

Figure 4:
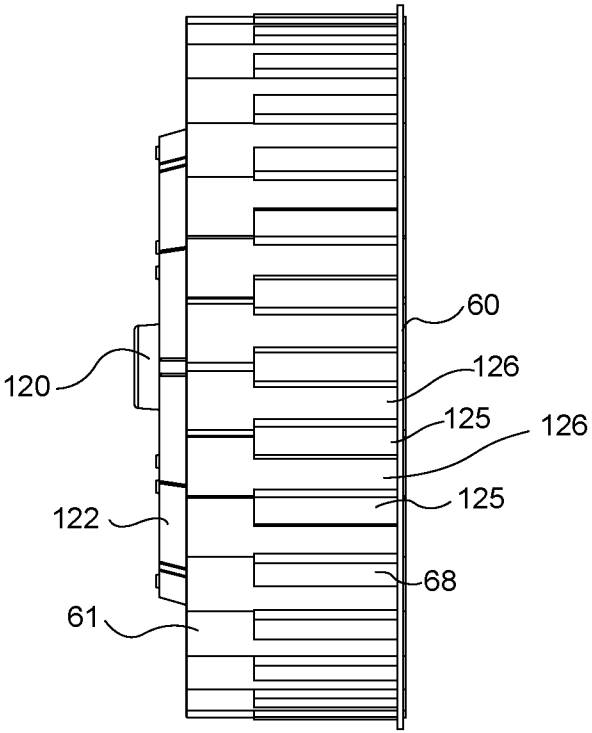
FIG. 4 is a side view of the drum without toy darts loaded therein in accordance with an embodiment of the present invention.

FIG. 4 depicts a side view of drum 60 without darts in accordance with an embodiment of the present invention. In the illustrated embodiment, substantially cylindrical projectile holders 61 on the outer concentric ring 62 of drum 60 are connected to each other by elongated ribs 68 that may extend, for example, between a range of approximately half to three-quarters of the width of drum 60 starting at the back side of drum 60 to strengthen drum 60. In embodiments, elongated ribs 68 do not extend the full width of the drum 60 so that, in embodiments, a spring-loaded catch 116 (with spring 117 above catch 116—as shown in FIG. 12(*a*)) may press against an outer surface of a respective projectile holder in outer concentric ring 62 to limit rotational movement of drum 60 when a projectile is launched. As drum 60 is incrementally rotated, catch 116 moves upward against the force of the spring 117 to allow drum 60 to rotate before the next projectile holder 61 is captured in catch 116.

Adjacent projectile holders 61 within each concentric ring 62, 64 have a divider between them. (FIG. 5) In embodiments, for inner concentric ring 64, a respective divider 123 between adjacent projectile holders 61 is formed by a conjoined section of respective outer rims 122 of adjacent projectile holders 61 on the back side of drum 60. In embodiments, for outer concentric ring 62, a respective divider 124 between adjacent projectile holders 61 is formed by outer rims 122 of openings 66 for adjacent projectile holders 61 on the back side of drum 60 that are not conjoined and have a space 121 between them (where the space is smaller than the cross-section of a pushing rod 70 as discussed below). In embodiments, space 121 may be a hollow space, such as for ease of fabrication, to reduce material costs, and to make drum lighter for carrying by a user, or may be partially or fully covered space under an elongated rib 68.

In embodiments, where the projectiles are toy darts, an example of a toy dart that may be used with launcher 1 of the present invention is a toy dart 63 in accordance with embodiments described in U.S. patent application Ser. No. 15/793,429, filed Oct. 25, 2017, which is commonly assigned to Easebon Services Limited and is incorporated by reference in its entirety as if fully set forth herein. In other embodiments, a different type of toy dart may be used with launcher 1 or a mixture of two or more different types of toy darts may also be used with launcher 1.

Examples of other toy darts 63 that may be used in conjunction with drum 60 and launcher 1 include a dart with a different style of cap or elongate body. However, the darts that are used must be sized to fit within a projectile holder 61 such that the dart is removably held in place while loaded in drum 60 with clearance from front wall 34 of recess 30 in launcher 1 when drum 60 is loaded in launcher 1. For example, if a toy dart is approximately 12.5 mm or approximately 12.7 mm in diameter, projectile holder 61 might be 0.1 mm larger in diameter than the diameter of the toy dart. Also, the darts used with launcher 1 must be sized and have sufficient friction on an outer surface for flywheel(s) to be able to exert a force on the outer surface of the dart and of sufficient diameter relative to the projectile holders 61 to be retained with the holders 61 during play.

Figure 5:
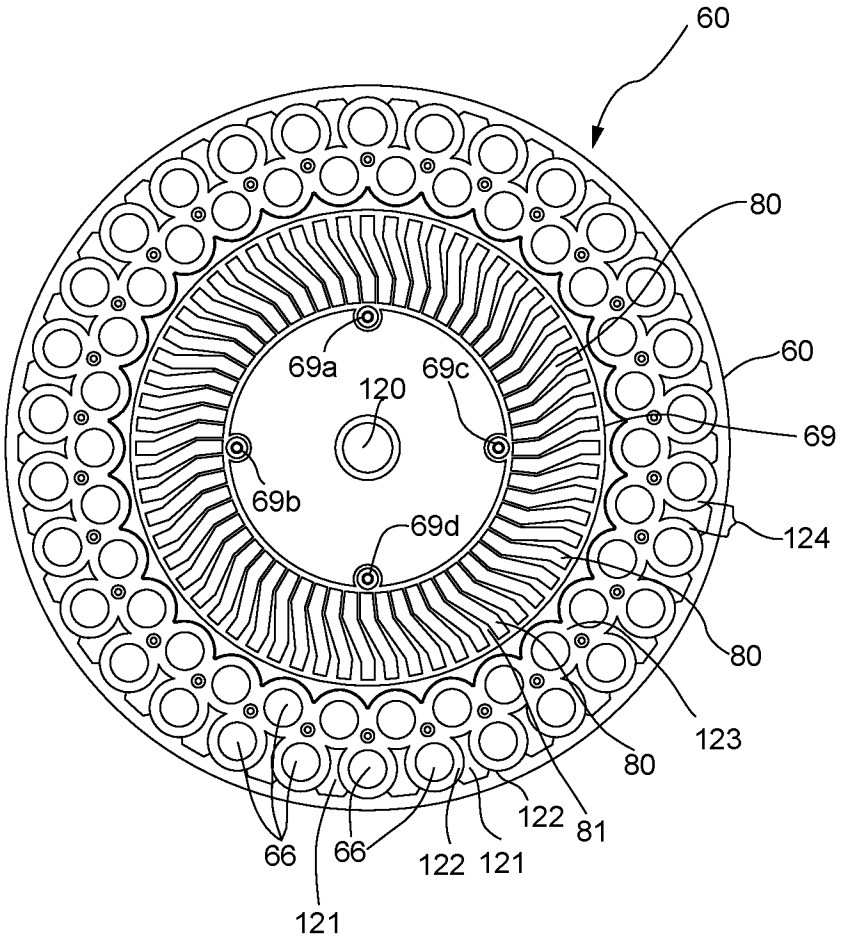
FIG. 5 is a back view of the drum of FIG. 3 in accordance with an embodiment of the present invention.
Figure 16A:
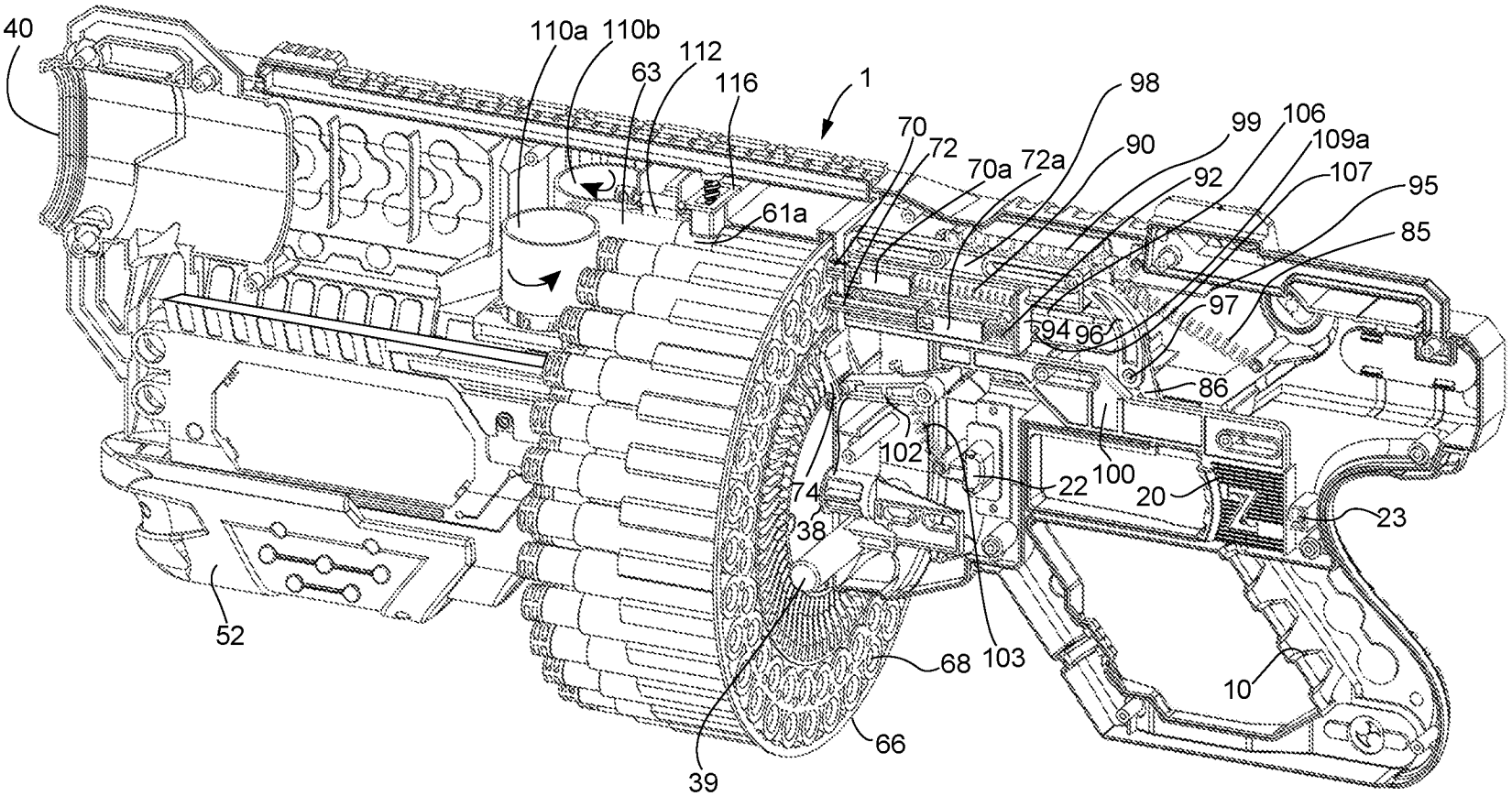
FIG. 16(*a*) shows a cutaway view of the toy dart launcher in perspective where the trigger has been activated in accordance with an embodiment of the present invention to launch a toy dart from a projectile holder in an outer concentric ring on the drum toward a target.
Figure 16B:
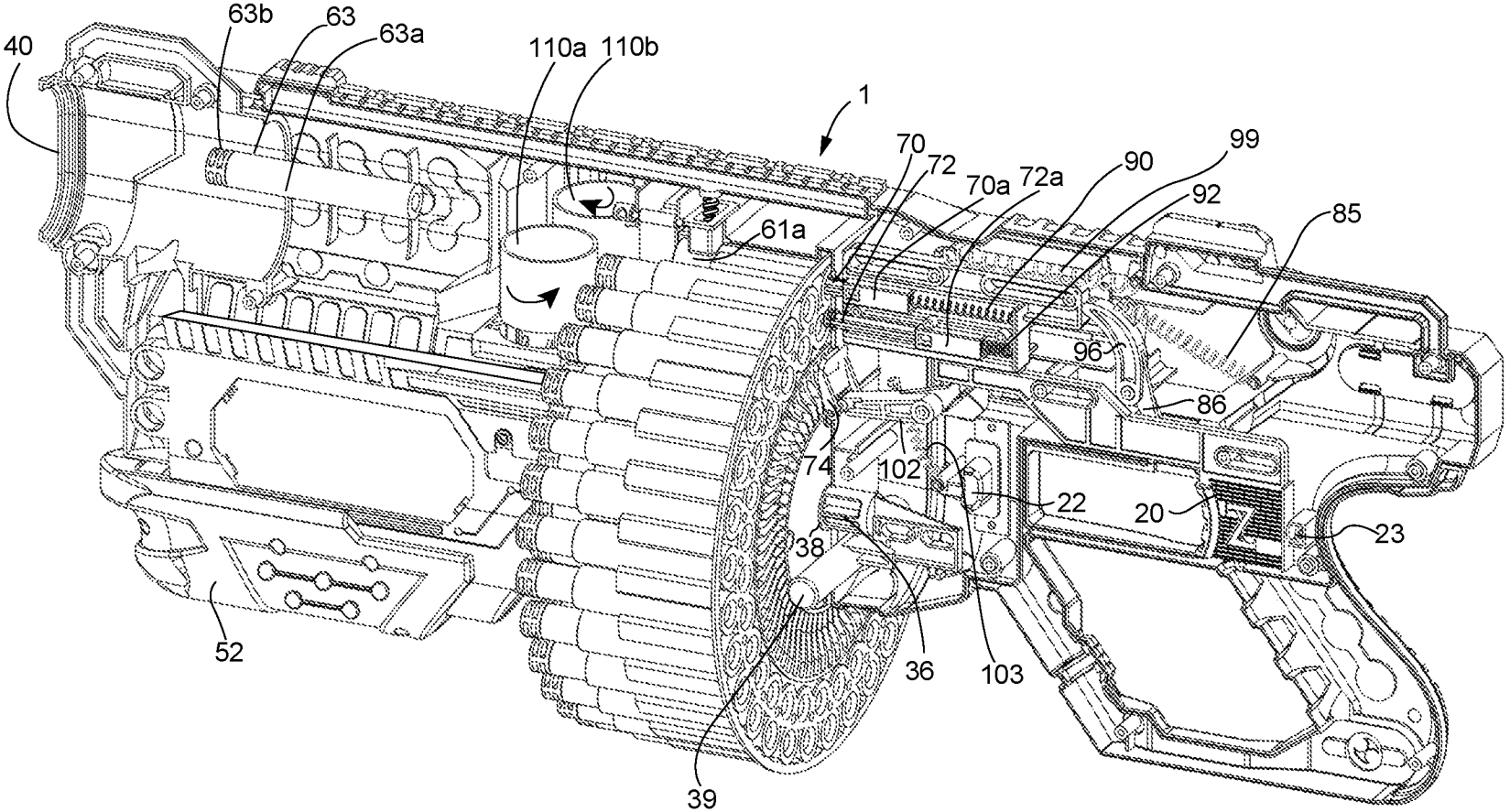
Figure 16C:
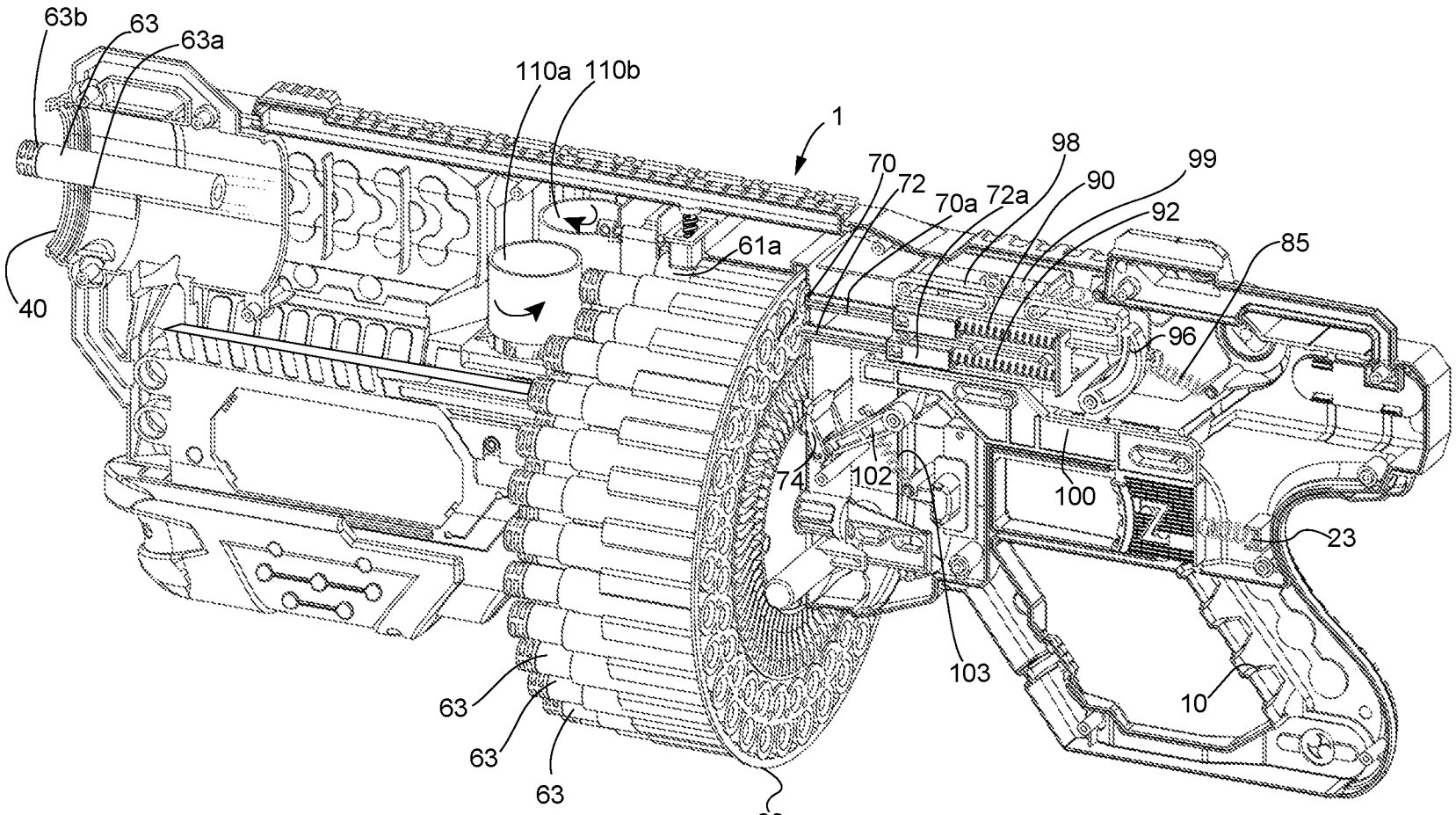

A sample toy dart 63 is shown, for example, in FIGS. 16(*b*) and 16(*c*), which depict the launch of a dart 63. Each dart 63 has an elongate dart body 63*a* and a cap 63*b* that is affixed to the dart body, where the cap 63*b* has a configuration that enables the dart to relatively accurately target a person or object and travel a relatively long distance, while impacting the target in a safe manner. Darts are loaded into projectile holders 61 via the front side of drum 60 as shown in FIG. 5. In embodiments, cap 63*b* and a portion of elongate dart body 63*a* may protrude from the front of drum 60 when loaded into drum 60. In other exemplary embodiments, dart 63 may be more recessed or fully within projectile holder 61.

FIG. 5 illustrates a view of a back side of drum 60. As shown in FIG. 5, the back of drum 60 includes a respective opening 66 for each projectile holder 61 in concentric rings 62, 64 of projectile holders. Each opening 66 is surrounded by a rim 122 such that the opening 66 is sized to be smaller than an outer diameter of elongate dart body 63*a* to prevent a dart 63 held in the respective projectile holder 61 from exiting out of the back of drum 60. At the same time, opening 66 is sized to enable a pushing rod, described below, with a diameter smaller than opening 66 to pass through opening 66 and push a dart loaded in drum 60 out through the front of drum 60 to be launched.

Also, on the back of drum 60, radially inward from inner concentric ring 64, is an inner circular segment 69 on which non-linear grooves 80, e.g., S-shaped grooves, are radially arrayed. As described below, the angled grooves 80 are configured for a projection 74T on pawl 74 (FIG. 16(*c*)) on launcher 1 to engage with one groove 80 at a time by moving pawl 74 upward in a substantially straight path from the inner edge of groove 80 outward along a path of the groove outward toward an outer edge of groove toward the inner concentric ring 62. Pawl 74 advances the rotation of drum 60 incrementally such that darts may be launched in a sequence starting with a dart in a first concentric ring, then a dart in the second concentric ring, then a dart in the first concentric ring, etc. The number of grooves 80 on a particular drum are equally spaced in a circle and generally equals the number of projectile holders 61, so that each angular rotation of drum 60 from one groove 80 to an adjacent groove 80 situates one projectile to be launched at a time. In embodiments, the rotation of drum 60 is limited to a single direction based on the movement of the pawl and the shape of grooves 80. For example, drum 60 may rotate clockwise when viewed from the back of launcher 1.

In embodiments, circular segment 69 with grooves 80 may be integrally formed with drum 60. Alternatively, in embodiments, drum 60 may be fabricated from multiple pieces that are coupled to one another. For example, circular segment 69 may be a separate piece that is connected on the back side of drum 60, such as with screws 69*a*, 69*b*, 69*c*, 69*d*.

Figure 6:
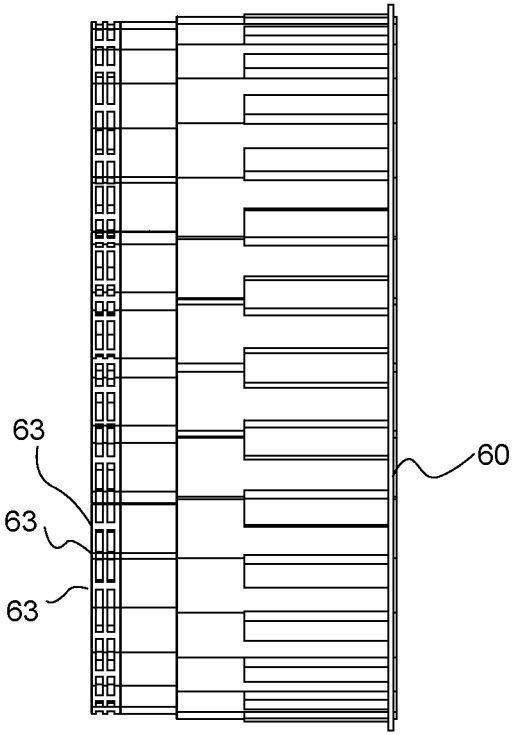
FIG. 6 is a side view of the drum showing exemplary toy darts loaded in the drum in accordance with an embodiment of the present invention.

FIGS. 3 and 6 show respectively front and side views showing toy foam darts loaded into drum 60. Darts 63 may be loaded before drum 60 is loaded into launcher 1 or may be loaded and reloaded after drum is inserted into launcher 1.

Figure 7:
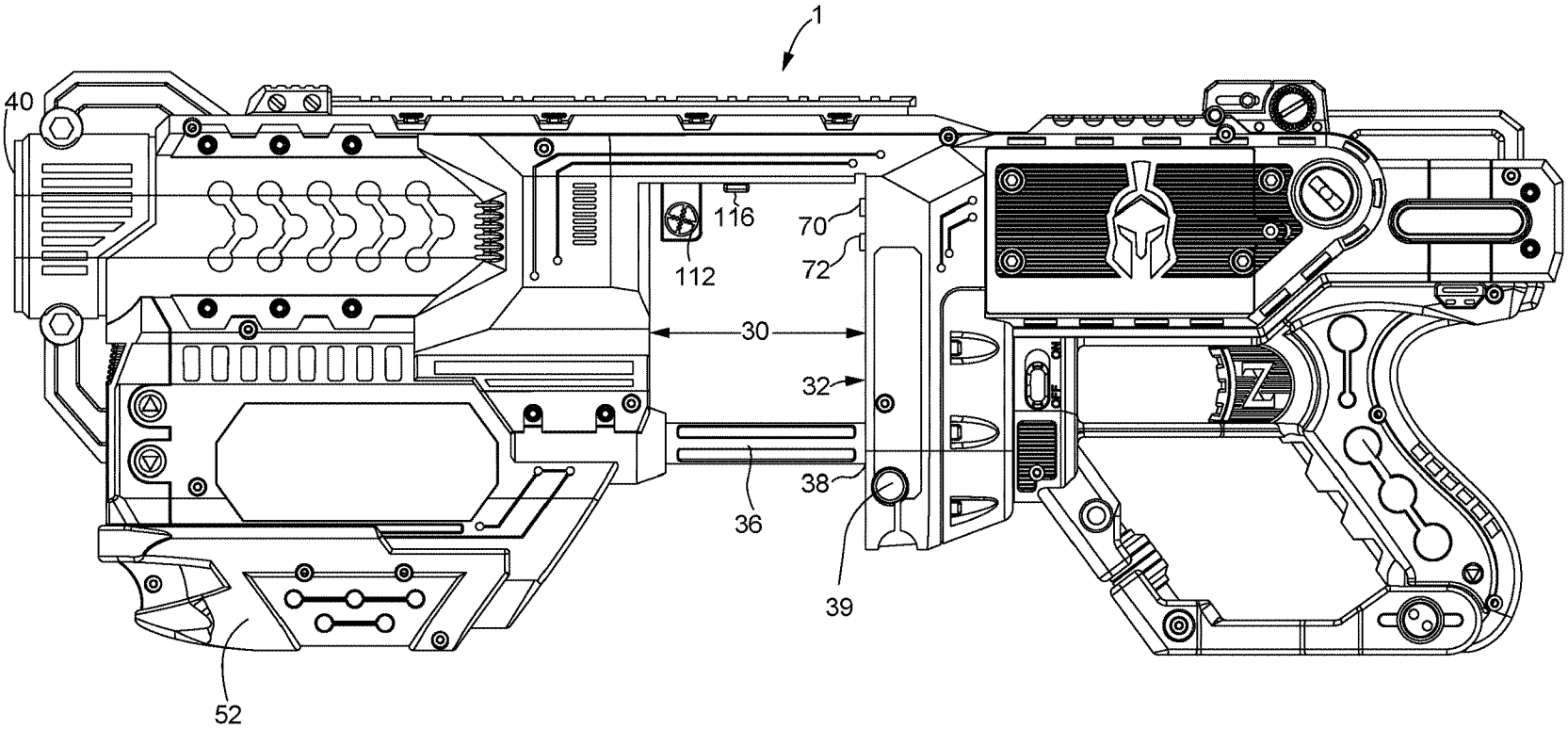
FIG. 7 shows a side view of the toy dart launcher before drum is loaded into the launcher in accordance with an embodiment of the invention.

FIGS. 7, 8, 9, 10, and 11 depict the loading of drum 60 into the designated space or recess 30 in launcher 1. In the illustrated example, darts 63 have not yet been loaded into drum 60 and may be loaded once drum 60 is inserted into launcher 1. In FIG. 7, rod 36 is in a closed position and passes into an opening 38 on back wall 32. Behind opening 36 is a releasable latch or lock (not shown) that engages rod 36 and holds rod 36 in a default closed position to prevent rod 36 from accidentally being retracted while drum 60 is in launcher 1.

Figure 8:
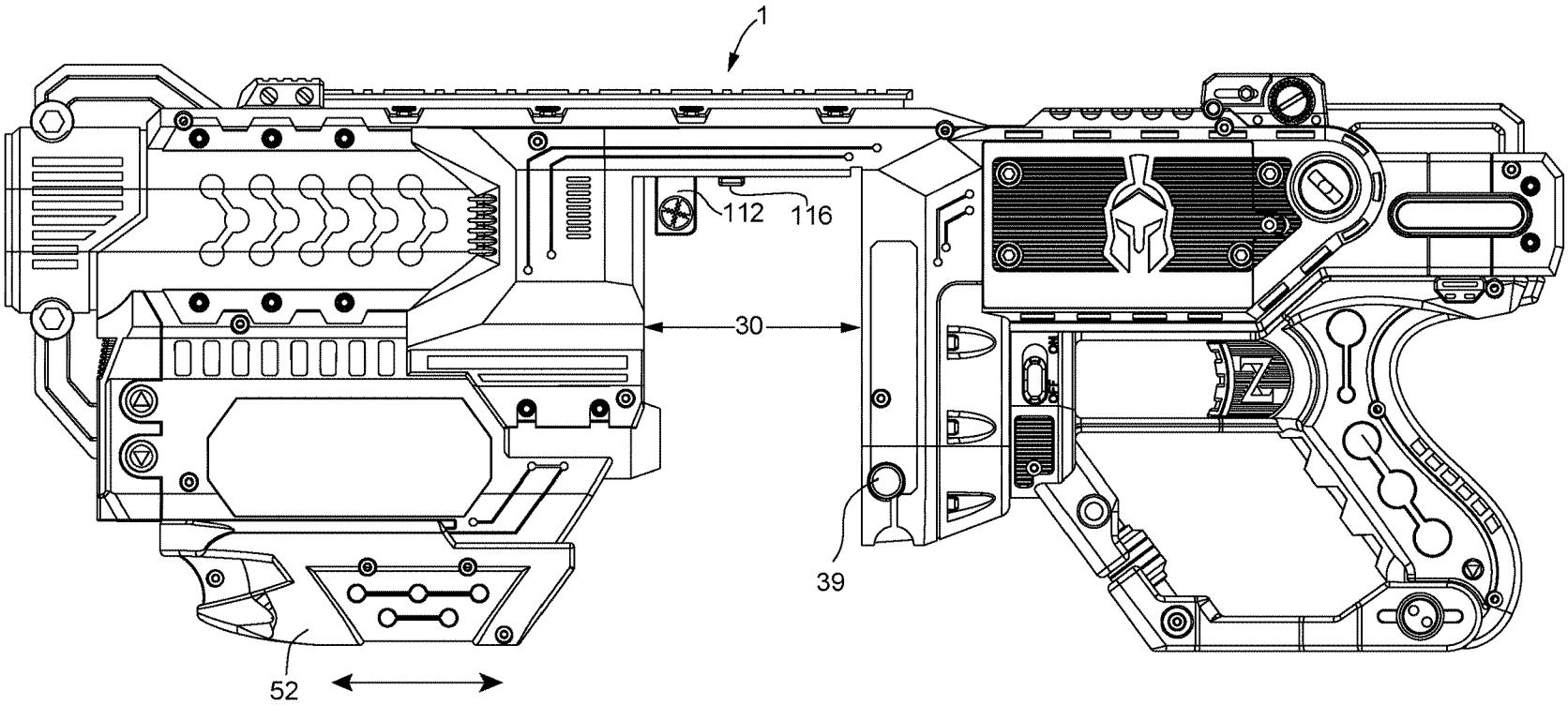
FIG. 8 shows a side view of the toy dart launcher where the retaining rod for the drum is withdrawn to enable the loading of the drum into the toy dart launcher in accordance with an embodiment of the present invention.

Front handle 52 is positioned at an initial position toward the front of launcher 1. In embodiments, to release rod 36 from the latch or lock, a user presses and holds a release button 39 (or, in other embodiments, a possibly different type of release) which allows front handle 52 to retract rod 36. Next, as shown in FIG. 8, front handle 52 is moved by a user rearward. This, in turn, via a linkage (not shown) between front handle 52 and rod 36, causes rod 36 to retract forward into an interior compartment 37 (FIG. 12(*a*)) that is located within the shell of the front of launcher 1 behind front wall 34. This allows clearance within recess 30 of launcher 1 to insert drum 60. The linkage used between handle 52 and rod 36 may be of a conventional type. For example, the linkage may be a mechanical linkage having one or more gears, whereby a backward movement of handle 52 rotates the one or more gears to retract rod 36. In other embodiments, instead of gears, another linkage, such as a rack and pinion, belts, cables, etc. to name a few, may be used.

Figure 9:
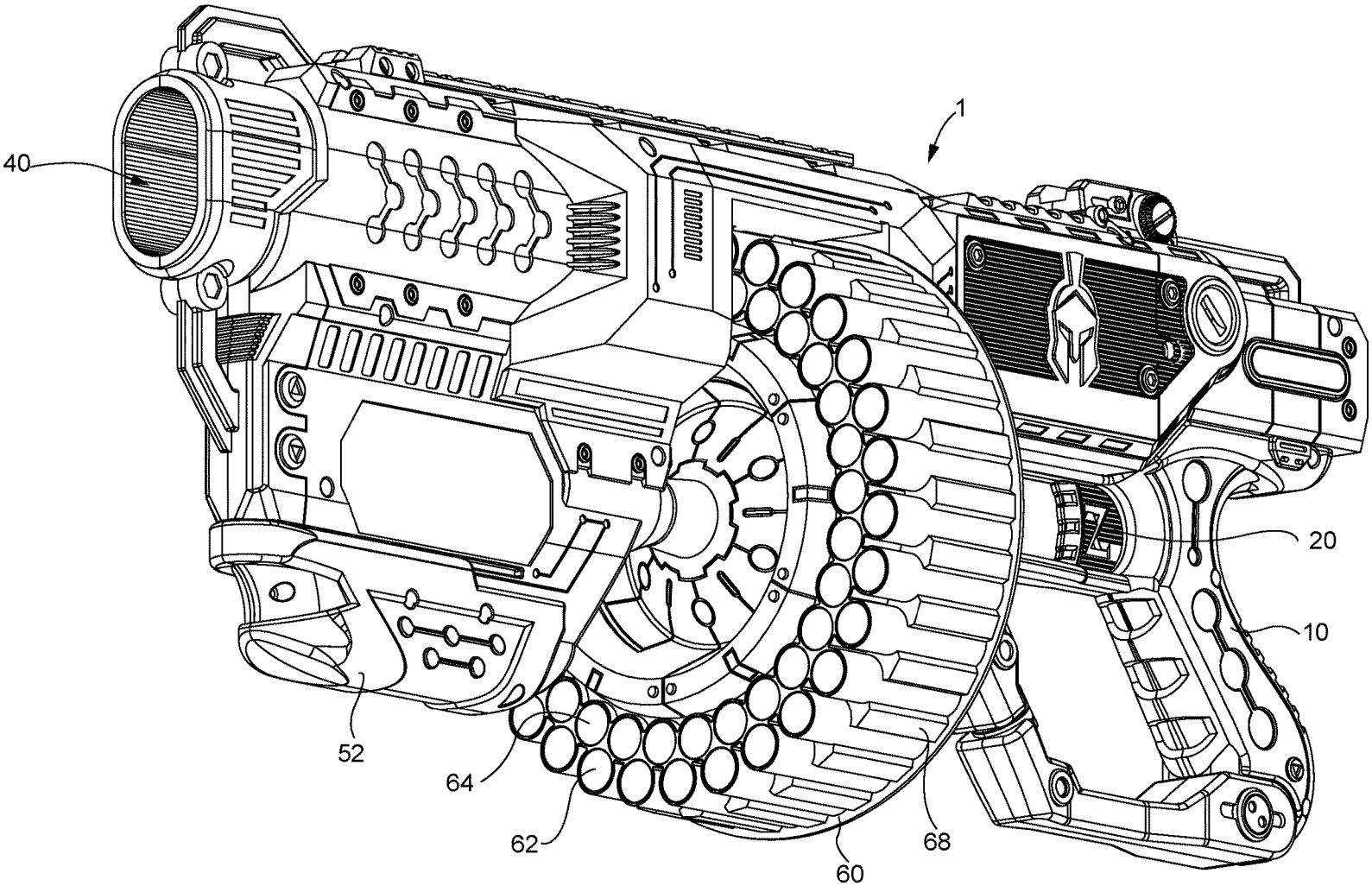
FIG. 9 shows a perspective view of the toy dart launcher, with the front of the drum visible, when the drum is loaded into the launcher in accordance with an embodiment of the present invention.
Figure 10:
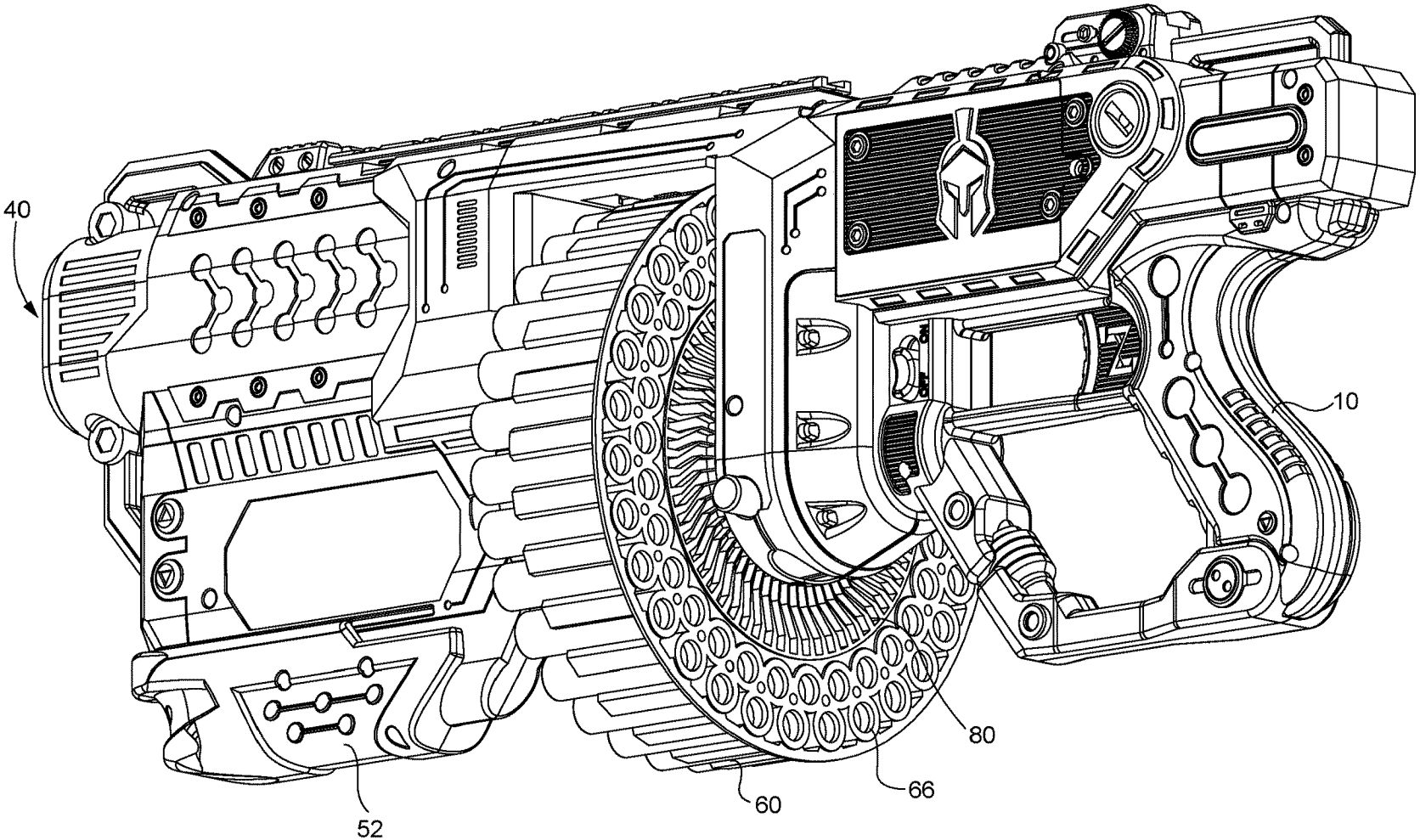
FIG. 10 shows another perspective view of the toy dart launcher, with the back of the drum visible, when the drum is loaded into the launcher in accordance with an embodiment of the present invention.
Figure 11:
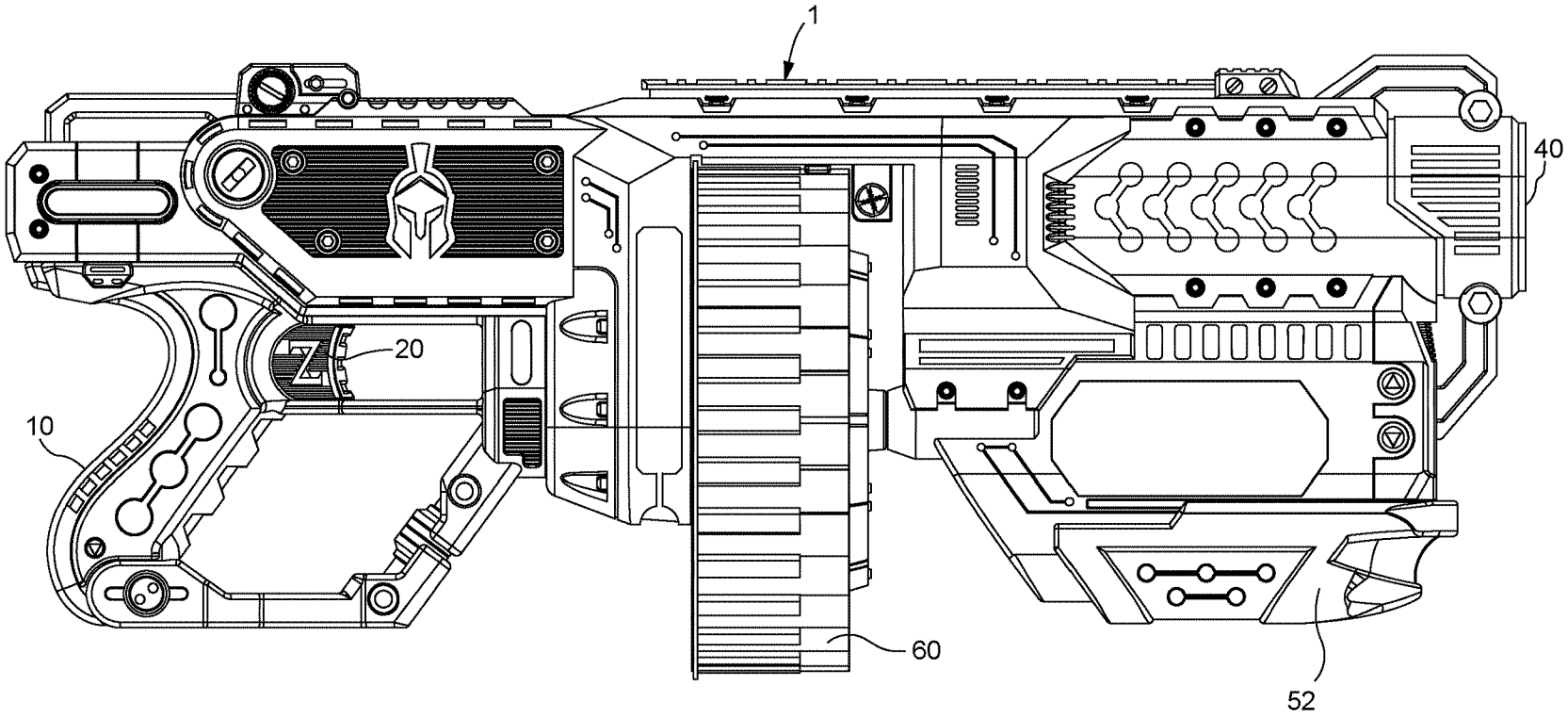
FIG. 11 shows a left side view of the toy dart launcher with the drum inserted in the launcher in accordance with an embodiment of the present invention.

With rod 36 retracted, drum 60 may be inserted into launcher 1 with center hole 120 aligned with rod 36. Handle 52 may then be moved forward and returned to its initial position thereby causing rod 36 to again extend into recess 30 through hole 120 on drum 60 to hold drum 60 in place as shown in FIGS. 9, 10, and 11.

FIG. 12(*a*) shows a right side view of launcher 1 with drum 60 inserted and the right side of outer shell of launcher 1 cutaway to highlight various interior components, including a projectile advancement assembly and flywheels 110*a*, 110*b* (not visible). FIG. 12(*b*) shows an enlargement of a back portion of the toy dart launcher shown in FIG. 12(*a*). The projectile advancement assembly is coupled to trigger 20 that, when activated (e.g., pulled or pressed), causes two or more pushing rods to move forward upon each activation of trigger 20. Trigger 20 is biased forward by a spring 23, which is compressed when trigger 20 is pulled.

In the illustrated embodiment, projectile advancement assembly includes two pushing rods 70, 72 as shown, with each pushing rod 70, 72 positioned to align with respective projectile holders 61 in respective outer and inner concentric rings 62, 64, generally aligning toward the center of the respective projectile holders. When drum 60 is inserted in launcher 1, these pushing rods 70, 72 push a projectile 63 in drum 60 forward one at a time to be propelled out of barrel 40 of launcher 1. Rods 70, 72 should be maintained substantially parallel to one another. A pawl 74 is also coupled to trigger 20 and causes an incremental angular rotation of drum 60 when trigger 20 is pressed.

Referring to FIGS. 12(*a*), 12(*b*), 16(*a*), and 17(*a*), in this illustrated embodiment, each of pushing rods 70, 72 is spring-loaded with a respective spring 90, 92 located toward the back of the respective pushing rod. In a rest state, each pushing rod 70, 72 extends from respective springs 90, 92 to approximately the back wall 32 of recess 30. Pushing rods 70, 72 and/or springs 90, 92 may be partially or wholly enclosed in one or more casings 70*a*, 72*a* (partially cutaway in FIG. 16(*a*)) that may be further enclosed in an outer casing (right wall cutaway) that includes back wall 94. In embodiments, the back end of springs 90, 92 are connected to back wall 94. In embodiments, one or more casings 70*a*, 72*a* may be coupled, such as with screws, to a movable upper mounting plate or bracket 98. Plate/bracket 98 may have guides 93*a*, 93*b*, and/or or slides that slidably move along (e.g., on top of) or between a track 95. Casings 70*a*, 70*b* or an outer casing around casings 70*a*, 70*b* may similarly have one or more guides (e.g., guide s 109*a*, 109*b*) that slidably move along or between one or more tracks (e.g., tracks 107, 106). In embodiments, tracks 95, 106 and 107 are mounted substantially horizontally and in alignment with one another. Plate/bracket 98 is connected via a spring 99 to an anchor point within launcher 1.

In this embodiment, springs 90, 92 for spring-loading pushing rods 70, 72, and mounting plate or bracket 98 may also be considered part of the projectile advancement assembly. In embodiments, mounting 100 may also be considered part of the projectile advancement assembly.

Pushing rods 70, 72 may vary in cross-section, but must fit through openings 66 on back of drum 60 and be long enough to displace the dart. For example, pushing rods 70, 72 may be circular in cross-section, as illustrated, or have some other shape, e.g., rectangular, triangular, to name a few. Because foam darts 63 may have an interior bore within an elongate dart body (see FIG. 16(*b*)), each pushing rod 70, 72 must also be larger in diameter or cross-section of the interior bore of the dart so as to press against the bottom of dart 63 and not pass into the interior bore of the dart.

A lower mounting plate or bracket 100, which is slidably forward and backward such as with one or more guides 89*a* along a track 100*a* and with one or more guides 89*b* along track 100*b*, is also coupled to trigger 20 such that, when trigger 20 is activated, plate/bracket 100 is moved backward along track 100*a*. This backward movement of plate/bracket 100 pushes backward the bottom of lever 86 that is mounted to plate/bracket 100 at connection 88. This, in turn, causes lever 96 to rotate about pivot point 97 such that the top of lever 96 is pushed forward. The slidably mounted plate 98 is engageable by lever 96 such that the movement of the top of lever 96, in turn, causes plate/bracket 98 to slide forward toward the front of launcher 1 to advance pushing rods 70, 72 when trigger 20 is activated. Lower bracket 100 is also coupled to lever 102 that rotates around pivot point 104. When trigger 20 is released and plate/bracket 100 moves forward, bracket 98 moves backward and the top of lever 96 is retracted.

It should be understood that the present invention may be practiced with pushing rods 70, 72 to be advanced via a different mechanism in lieu of one or more plates or brackets and levers. For example, pushing rods 70, 72 may be coupled to trigger 20 via an automated device that cause rods 70 and 72 to advance.

Lever 102 is further coupled to pawl 74 at link 108 and is spring-loaded via spring 103 that is mounted to a mount 105. Upon activation of trigger 20, backward movement of lower bracket 100 pulls on the top of lever 102 which causes lever 102 to rotate around pivot point 104. When the top of lever 102 is pulled rearward by bracket 100, the top of pawl 74 is pushed upward in a substantially straight line through slot 76 on back wall 32 of recess 30. When a drum 60 is inserted in launcher 1, a projection 74T on pawl 74 enters a respective groove 80 on back of drum 60 and travels through non-linear groove 80 causing drum 60 to incrementally rotate by an incremental angle. A spring (extension spring) 103 that is connected to lever 102 is stretched be the upward motion of pawl 74. When trigger 20 is released, pawl 74 is pulled downward and backward to its default position by spring 103. As pawl 74 is lowered, projection 74T is withdrawn from the groove 80 in which it had upwardly passed and is repositioned in alignment with the next groove 80 to engage the next groove 80 at the next activation of trigger 20.

Figure 13:
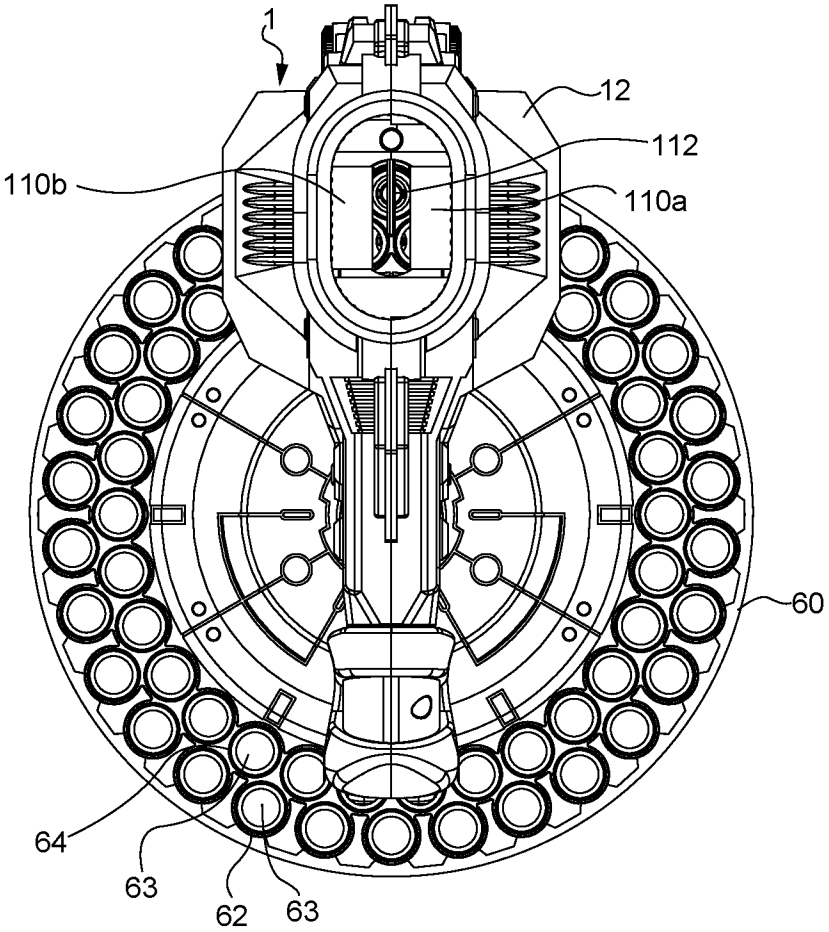
FIG. 13 shows a front view of the toy dart launcher with the drum loaded in the launcher in accordance with an embodiment of the present invention.

FIGS. 12 and 13 illustrate flywheels 110*a*, 110*b* that lie in a path of the projectiles, e.g. darts 63, that are pushed out of the top of drum 60 by projectile advancement assembly. In embodiments, flywheels 110*a*, 110*b* are motorized and are powered by batteries to be loaded in battery compartment 60 (FIG. 1). When switch 22 is turned on, one or both flywheels are powered by power supply 50. In embodiments, when powered on, flywheel 110*a* rotates counterclockwise and flywheel 110*b* rotates clockwise. In other embodiments, only one of the flywheels 110*a*, 110*b* may rotate with a motor and the other flywheel may freely rotate.

Flywheels 110*a*, 110*b* are each shown as an elongated flywheel that extends in front of both concentric rings 62, 64 of drum 60. However, in embodiments, there may be two flywheels in place of each of flywheel 110*a* and/or flywheel 110*b*, with each of the flywheels only aligned with one of the concentric rings 62, 64 such that a first set of opposing flywheels would launch a dart pushed from a first concentric ring 62 and a second set of opposing flywheels would launch a dart pushed from a second concentric ring 64.

As shown in FIGS. 2, 12(*a*), 13 and 16(*a*), tab 112 serves as a safety mechanism. When a regular dart, i.e., not broken and of a length that is within the parameters for which launcher 1 is designed is loaded into drum 60, a front of the dart (such as a portion of the dart cap or the dart cap and a portion of the body of the dart) that protrudes beyond the depth of the projectile holder 61, as shown, for example, in FIG. 16*a*, brushes against tab 112 and tab 112, which is hinged, would move to one side and allow for the dart to be moved forward. However, when a dart that is not designed to work with launcher 1 (e.g., a short dart), a broken dart (i.e., a piece is missing), or a non-dart, such as a small battery or pen cap is inserted into a projectile holder 61 in drum 60, its shorter length cannot reach and brush aside tab 112. Tab 112 therefore functions as a safety arm that prevents these irregular or broken types of darts from moving toward the flywheels and being launched. The use of a safety arm is further described in U.S. Pat. No. 9,500,432, which is commonly assigned to Easebon Services Limited and is incorporated by reference in its entirety as if fully set forth herein.

Spring-loaded clip 116 presses against drum 60 when inserted in launcher 1 to limit rotational movement of drum 60 when a projectile is launched.

Figure 14:
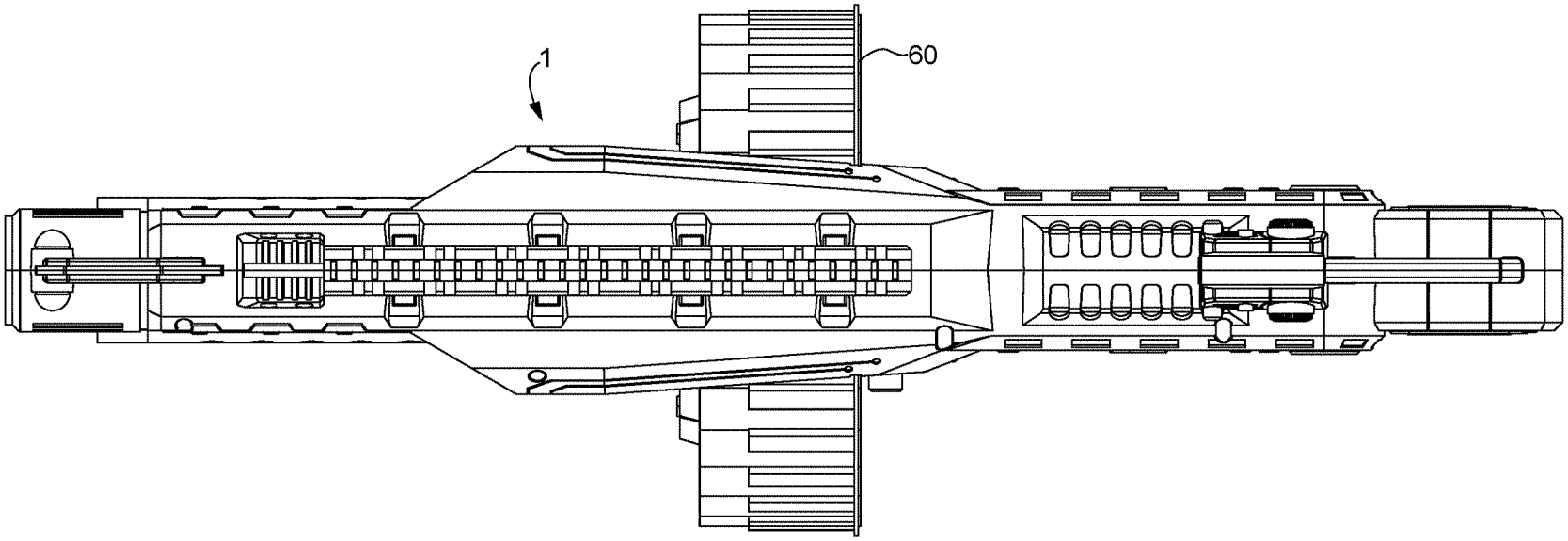
FIG. 14 shows a top view of the toy dart launcher with the drum loaded in the launcher in accordance with an embodiment of the present invention.

FIG. 13 shows a front view of launcher 1 with drum 60 in accordance with an exemplary embodiment of the invention. Flywheels 110*a*, 110*b* are visible through the front of barrel 40 as is tab 112 that is aligned at the center of a projectile holder 61, in this case, a projectile holder 61 of outer concentric ring 62. When drum 60 is rotated to the next increment, tab 112 will be aligned with a projectile holder 61 in inner concentric ring 64. FIG. 14 shows a top view of the launcher of FIG. 13.

Figure 15:
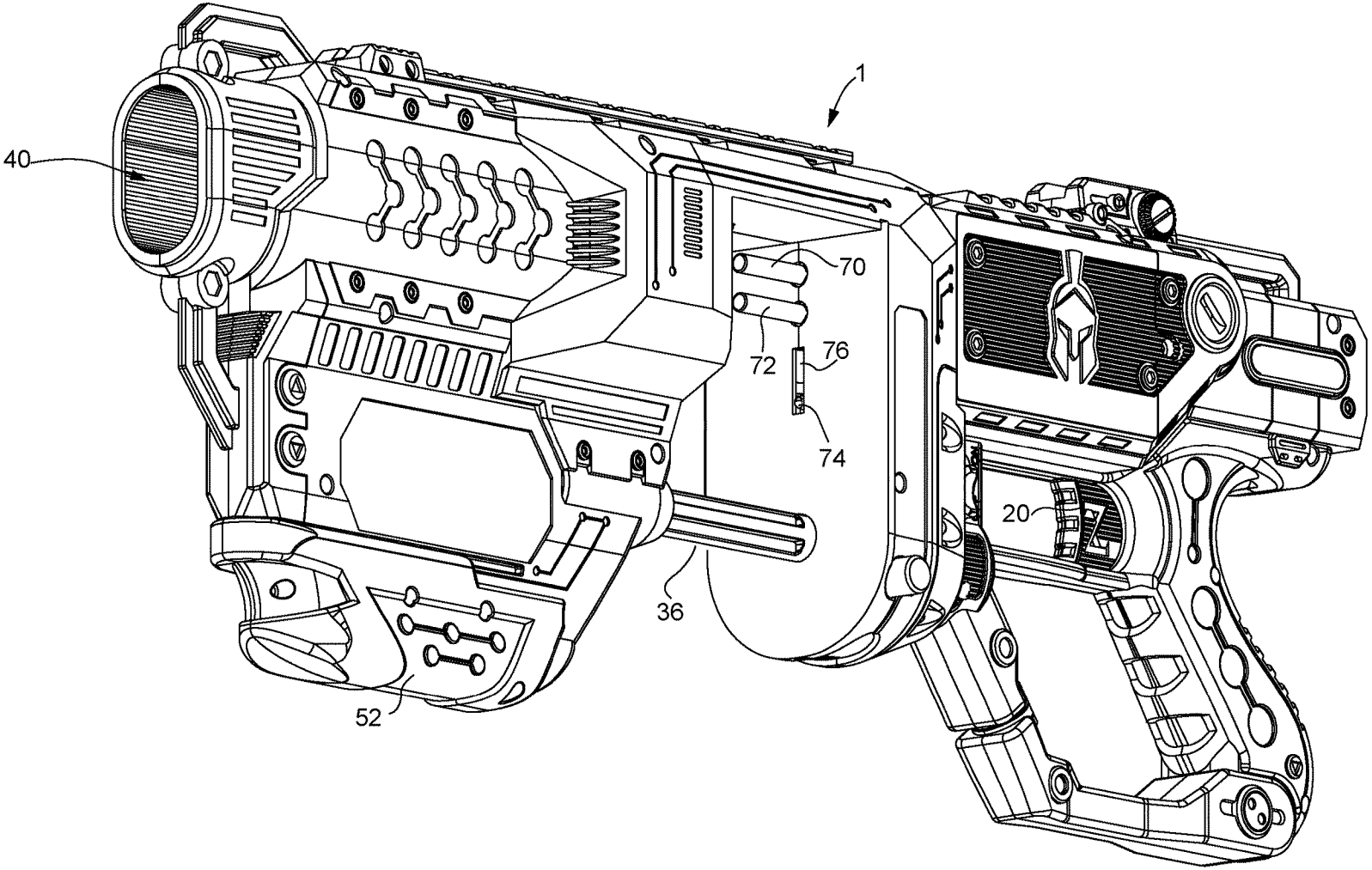
FIG. 15 shows a perspective view of the toy dart launcher without the drum where the trigger has been activated in accordance with an embodiment of the present invention.

FIG. 15 shows the movement of pushing rods 70, 72 that would occur when launcher 1 is powered up and trigger 20 is activated without a drum 60 inserted in launcher 1. In this case, both pushing rods 70, 72 advance forward out of back wall 32 of recess 30 and no compression force is exerted on springs 90, 92 because there is no obstacle, e.g., a divider of projectile holders on drum 60, to prevent the advance of both pushing rods 70, 72.

Figure 17A:
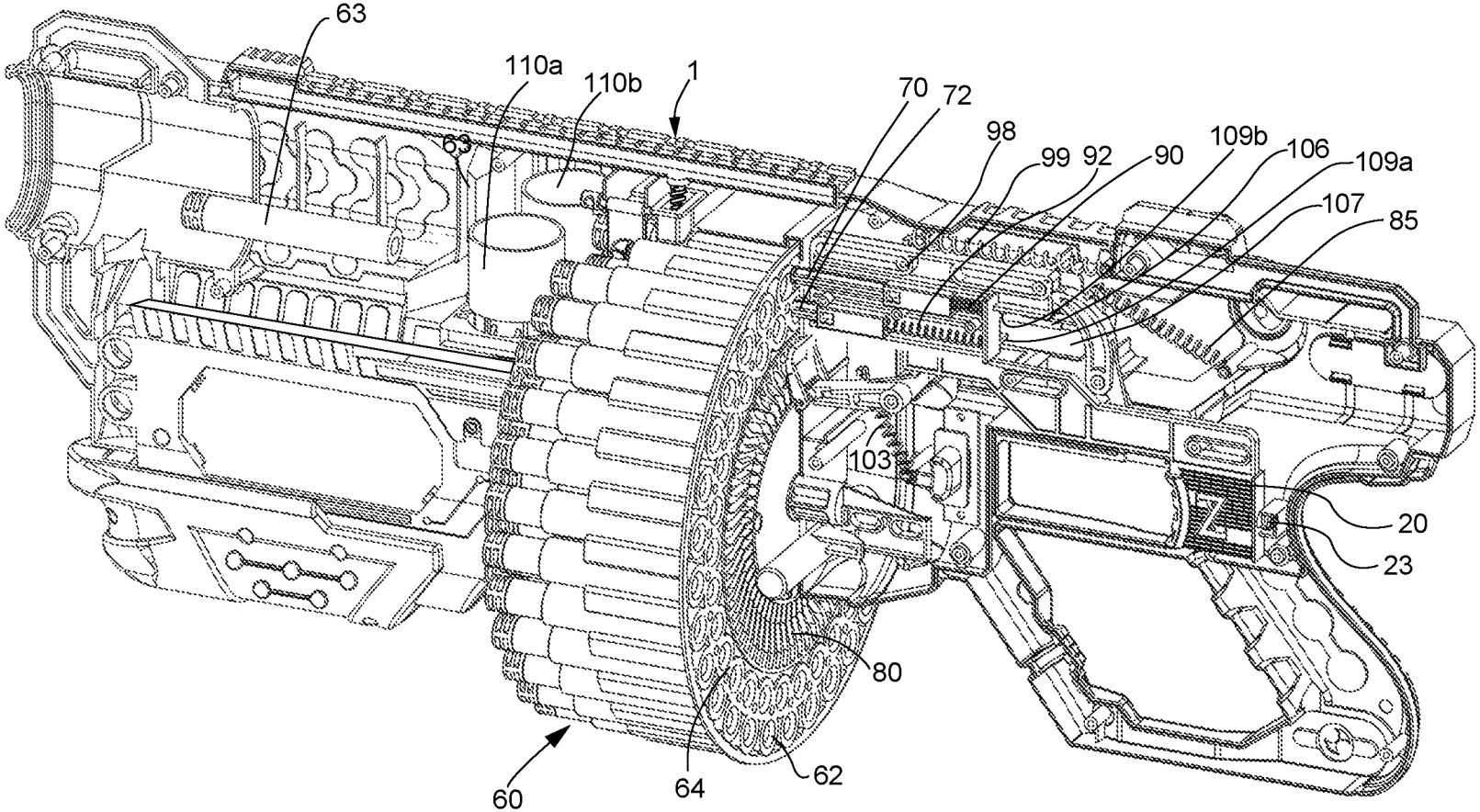
FIG. 17(*a*) shows a cutaway view of the toy dart launcher in perspective where the trigger has been activated with the drum loaded in the launcher in accordance with an embodiment of the present invention to launch another toy dart from a projectile holder in an adjacent projectile holder from an inner concentric ring on the drum.
Figure 17B:
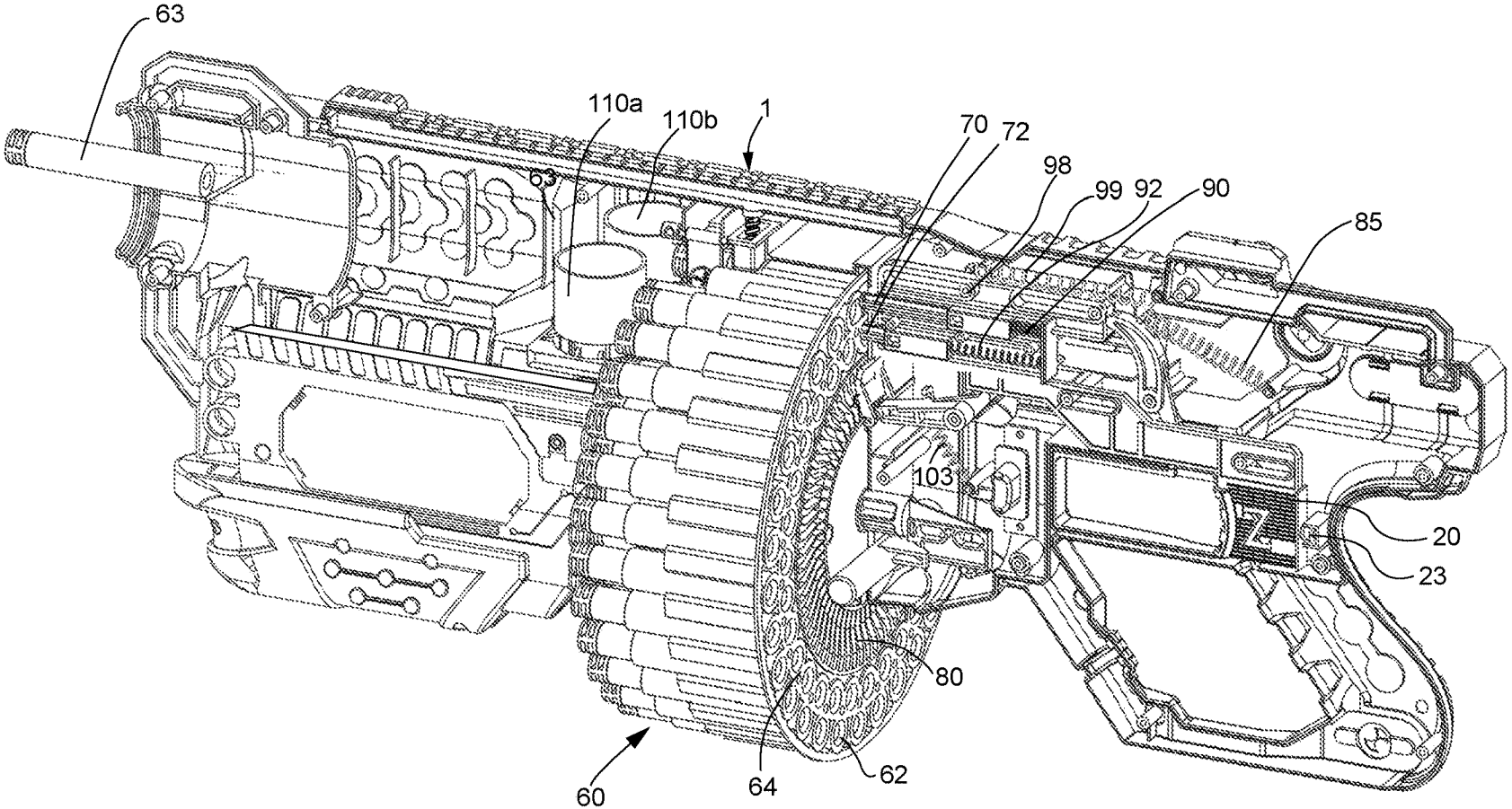

FIGS. 16(*a*), (*b*) and (*c*) and FIGS. 17(*a*) and (*b*) illustrate the operation of launcher 1 when a drum 60, with darts as projectiles 63, is inserted in launcher 1. As noted above, the darts 63 are launched sequentially and in a staggered pattern, alternating between adjacent projectile holders 61 in the two concentric rings 62, 64. Thus, a first dart is shot from a first concentric ring, then a second dart is shot from a second concentric ring, then a third dart is shot from the first concentric ring, then a fourth dart is shot from the second concentric ring, etc.

For purposes of illustration, FIGS. 16(*a*), 16(*b*) and 16(*c*) show a dart launched from outer concentric ring, and FIGS. 17(*a*) and 17(*b*) show the launch of another dart from inner concentric ring that is next in sequence to be launched. However, it should be understood that sometimes, depending on the rotational angle of drum 60 when the trigger 20 is pulled, the first dart in line to be shot may be a dart from the inner concentric ring, and then a second dart to be shot is a dart from the outer concentric ring. When there is no dart loaded in a particular projectile holder 61, no dart will be launched from that projectile holder 61 by pushing rods 70, 72 until that holder 61 is refilled with a dart.

In operation, launcher 1 is powered on by flipping a switch 22, causing motorized flywheels 110*a*, 110*b* to rotate. Flywheels 110*a*, 110*b* may continue to rotate while launcher 128 is powered on. As shown in FIG. 16(*a*), when a user activates trigger 20, such as by pulling it backward, plate/bracket 100 moves backward, thereby causing the front of lever 102, which is coupled to pawl 74, to move upward and push pawl 74 into and upward within a respective groove 80 on drum 60. The upward movement of pawl 74 through groove 80 causes drum 60 to rotate by a single angular increment. Then, plate or bracket 98 slides forward, thereby applying a forward push on springs 90, 92 which themselves push on pushing rods 70, 72. In FIG. 16(*a*), upper pushing rod 70, which is radially aligned with the outer concentric ring 62 on drum 60, and is directly aligned at that moment with a first projectile holder 61*a* of projectile holders 61 in the outer concentric ring 62, engages a dart 63 that is loaded in the outer concentric ring 62 and pushes dart 63 forward out of drum 60 into engagement with motorized flywheels 110*a*, 110*b*. The rotating flywheels 110*a*, 110*b*, in turn, contact an outer surface of dart 63, and propel the dart forward (FIG. 16(*b*)) and out of launcher 1 (FIG. 16(*c*)). Because pushing rod 70 is able to move forward through respective opening 66 in the back of drum 60 to advance a dart, minimal or no force is placed on spring 90 at that point.

At the same time that the upper pushing rod 70 is pushing the dart 63 out of drum 60, the pushing rod 72, which is radially aligned with inner concentric ring 64 of projectile holders 61, is also pushed forward by the plate/bracket 98 to be launched. However, because inner concentric ring 64 is angularly offset from outer concentric ring 62, the path of pushing rod 72 is blocked by divider 123, best shown in FIG. 5, that separates adjacent projectile holders in the inner concentric ring 64 of drum 60. Thus, spring 92 that is coupled to the lower pushing rod is compressed and the lower pushing rod 72 corresponding to inner concentric ring 64 does not advance into any projectile holder 61 in drum 60 at that time so that only one dart is launched with no dart being launched via movement of that pushing rod 72 at that moment. After each dart 63 is launched, plate/bracket 98 retracts (pulled by spring 99 returning to its rest position) and both spring-loaded pushing rods 70, 72 return to their rest state. Pawl 74 also returns to its rest state, pulled by spring 103.

Referring to FIGS. 17(*a*) and 17(*b*), upon a next activation of trigger 20, drum 60 again rotates by a single angular increment as pawl 74, engages a respective groove 80 on drum 60, and moves upward through a groove 80. Then, plate/bracket 98 slides forward, thereby applying a forward push on springs 90, 92 which themselves push on pushing rods 70, 72. In FIG. 17(*a*), the second, lower pushing rod 72, which is radially aligned with the inner concentric ring 64 on drum 60, and is directly aligned at that moment with a first projectile holder of projectile holders 61 in the inner concentric ring 64, engages a dart 63 that is loaded in the inner concentric ring 64 and pushes dart 63 forward out of drum 60 and toward and into engagement with between motorized flywheels 110*a*, 110*b*. The rotating flywheels 110*a*, 110*b*, in turn, contact an outer surface of dart 63, and propel the dart forward (FIG. 17(*b*)) and out of launcher 1. Because pushing rod 72 is able to move forward through respective opening 66 in the back of drum 60 to advance a dart, minimal or no force is placed on spring 92 at that point.

At the same time that the lower pushing rod 72 is pushing the dart 63 out of drum 60, the first, upper pushing rod 70, which is radially aligned with outer concentric ring 62 of projectile holders 61, is also pushed forward by the plate/bracket 98 to be launched. However, because outer concentric ring 62 is angularly offset from inner concentric ring 64, the path of pushing rod 70 is blocked by divider 124, best shown in FIG. 5, that separates adjacent projectile holders 61 in the outer concentric ring 62 of drum 60. Thus, spring 90 that is coupled to pushing rod 70 is compressed but the pushing rod 70 corresponding to outer concentric ring 62 does not advance into any projectile holder 61 in drum 60 at that time. Therefore, only one dart is launched at that moment with no dart being launched via movement of pushing rod 70. After each dart 63 is launched, plate/bracket 98 retracts (pulled by spring 99 returning to its rest position) and both spring-loaded pushing rods 70, 72 return to their rest state. Pawl 74 also returns to its rest state, with a force provided by spring 103.

When trigger 20 is next activated, drum 60 again advances a groove 80 and launches a third dart 63 from outer concentric ring 62. The process repeats, launching darts alternatively from a first concentric ring, than from a second concentric ring, then from the first concentric ring, then from the second concentric ring, etc. When all or at least some of the darts are fired, a user may reload any vacant projectile holders 61 in drum 60 with one or more darts.

In embodiments, lever 96 may be spring-loaded with a tension spring 85 attached to lever 96 toward a top of lever 96 such that when the top of lever 96 is rotated forward when trigger 20 is activated, spring 85 is extended and when trigger 20 is released, spring 85 retracts the top of lever 96 backward.

Figure 18A:
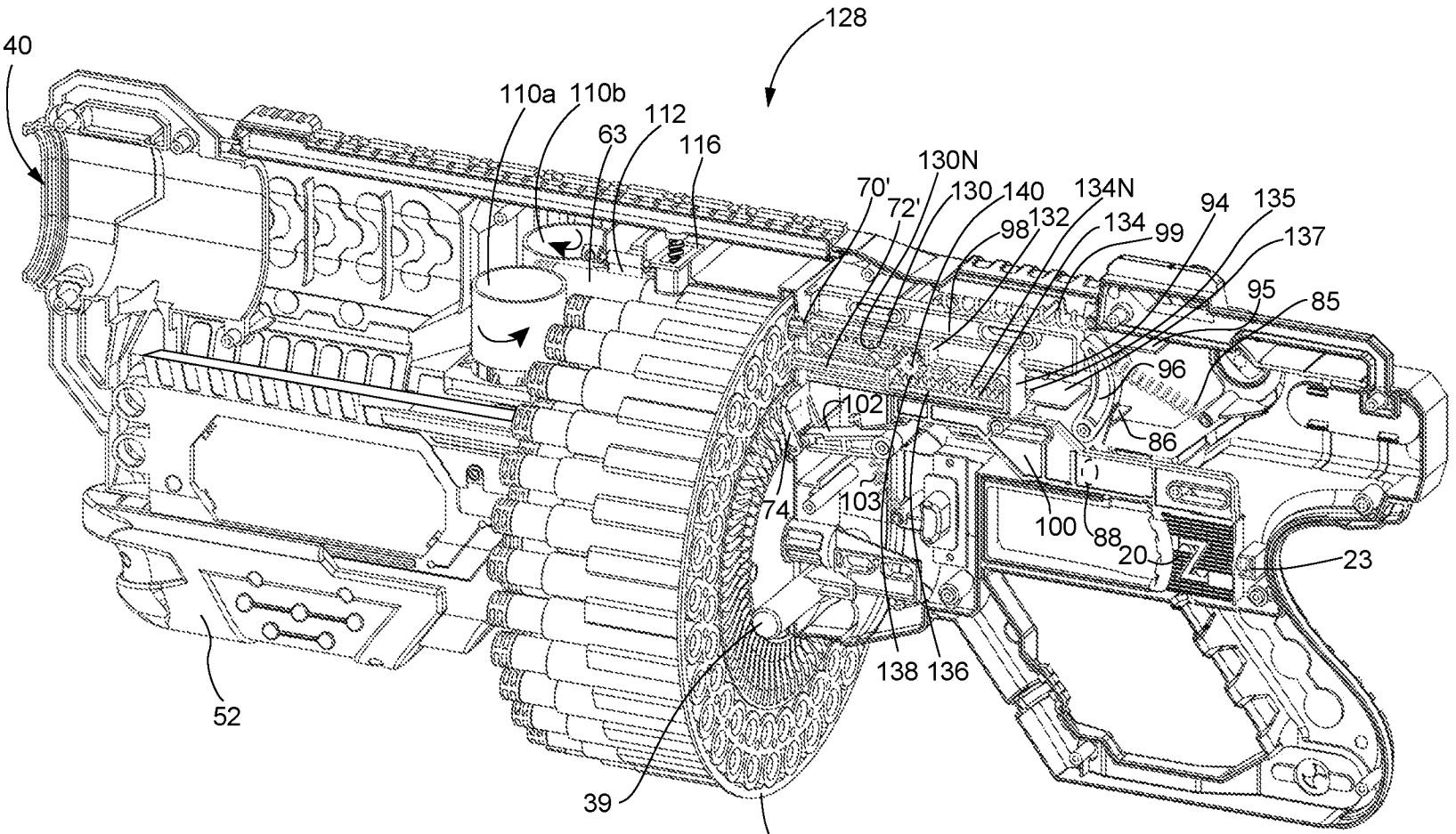
FIG. 18(*a*) shows a cutaway view in perspective of a toy dart launcher in accordance with a second embodiment of the present invention where the trigger has been activated to launch a toy dart from an outer concentric ring.
Figure 18B:
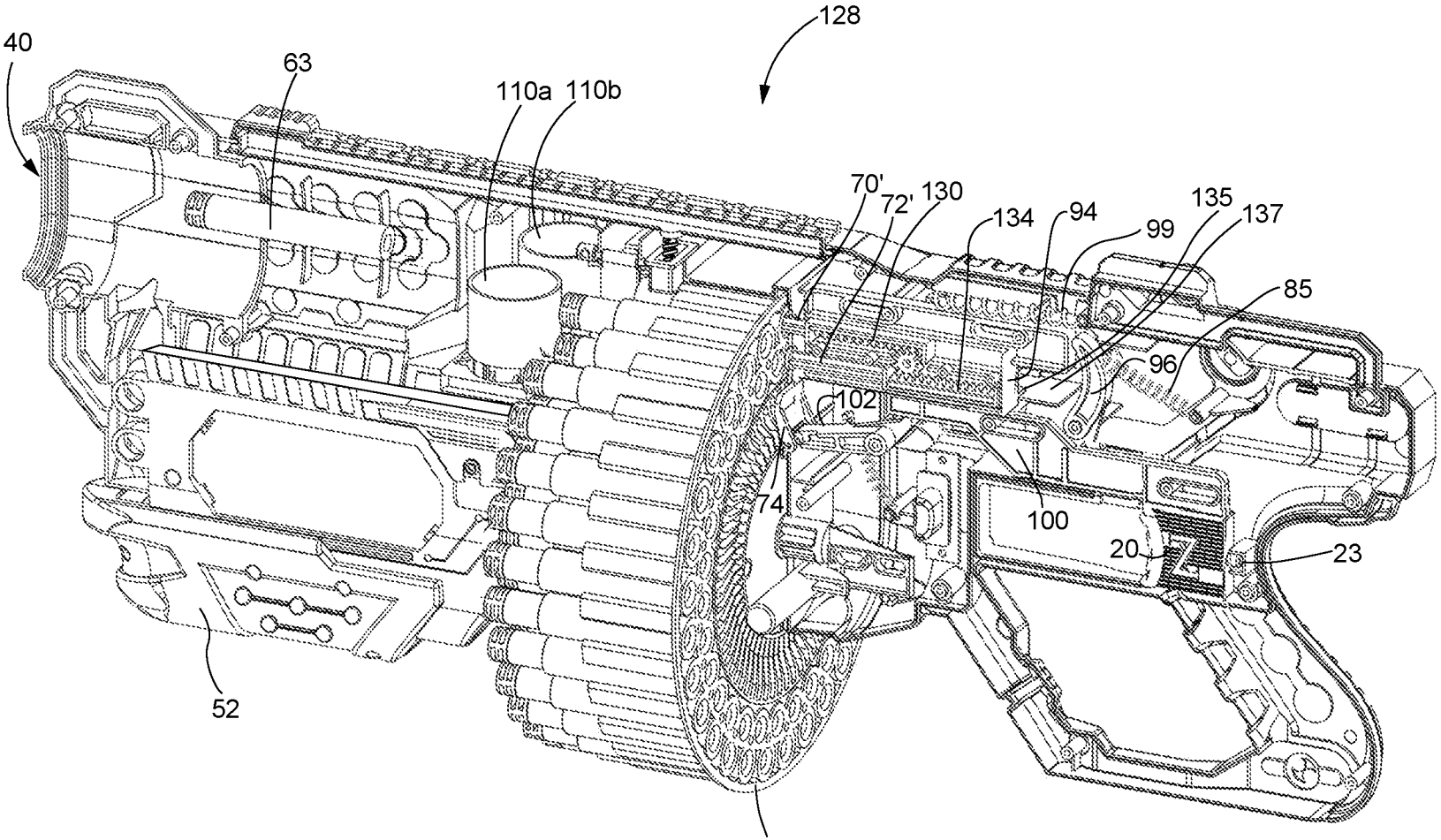
Figure 18C:
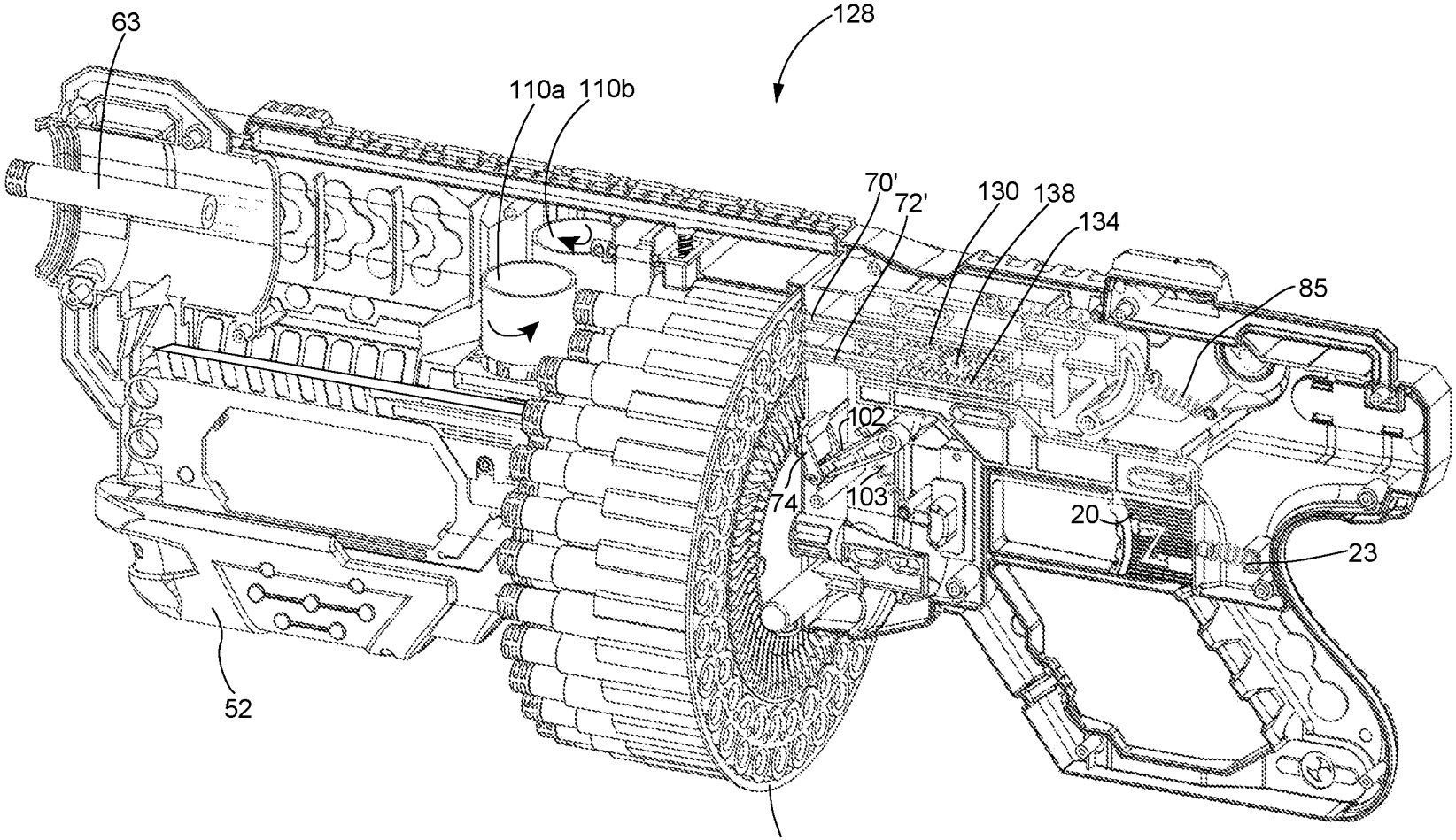

Another exemplary embodiment of a toy launcher in accordance with the present invention is shown in FIGS. 18(*a*), 18(*b*) and 18(*c*). In this exemplary embodiment, the components in the launcher may be the same as shown in the embodiment of FIG. 12(*a*) (e.g., same or similar trigger, upper and lower brackets 98 and 100, drum 60, flywheels 110*a*, 110*b*), barrel 40, etc.). However, instead of using springs 90, 92 to spring load pushing rods 70, 72, each of pushing rods 70', 72' have a respective rear rod extension 130, 134 that have a rack or an edge with notches 130N, 134N (i.e., notches or serrations). Upper rear rod extension 70' has a rack or the notches 130N on its lower edge and lower rear rod extension 72' has a rack or notches 134N on its upper edge. In embodiments, rear rod extensions 130, 134 may be formed integrally with respective pushing rods 70', 72' or, in embodiments, rear rod extensions 130, 134 may be coupled to respective pushing rods 70', 72'.

In embodiments, each of pushing rods 70', 72' with rear rod extensions 130, 134 may be contained with a respective casing 132, 136, which may, in turn, be enclosed within an outer casing that includes back wall 94, such as is shown in FIGS. 18(*a*), 18(*b*), and 18(*c*). Each casing 132, 136, or the outer casing with back wall 94, has a projection that slides on a track mounted to the left side of launcher 128. For example, casing 136 which covers rear rod extension 134 has a slide 135 and/or guides that slide on track 137. Casing 132 may have a similar slide 142 and/or guides that slide along a track 143 (FIG. 19(*a*)). A pinion gear 138 is placed on a post 140, such as a metal post, mounted in a fixed position within the outer casing that includes back wall 94. Gear 138 is allowed to freely rotate about post 140. Teeth on pinion gear 138 mesh with the rack or notches 130N on rear rod extension 130 positioned above gear 138 and rack or notches 134N on rear rod extension 134 that are positioned below gear 138. Rods 70', 72' should be maintained substantially parallel to one another.

In this second embodiment, rear rod extensions 130, 134, gear 138, and mounting plate or bracket 98 may also be considered part of the projectile advancement assembly. In embodiments, mounting plate or bracket 100 may also be considered part of the projectile advancement assembly.

FIG. 18(*c*) shows the position of pushing rods 70', 72' when both rods are at rest, fully retracted from the drum 60. When at rest, gear 138 may be situated approximately midway between both rear rod extensions 130, 134. It should be understood that although FIG. 18(*c*) depicts this situation in an example where a dart 63 has been launched, the rods may be in a rest position before any dart is launched.

FIG. 18(*a*) depicts the operation of launcher 128 when it is powered on, such as by flipping switch 22. When energized, motorized flywheels 110*a*, 110*b* begin to rotate and may continue to rotate while launcher 128 is powered on. A user activates trigger 20, such as by pulling it backward, which presses against spring 23. This causes drum 60 to rotate by a single angular increment when pawl 74 engages a respective groove 80 on drum 60 and moves upward through groove 80. Then, plate or bracket 98 slides forward with a push from a top of lever 96, thereby applying a forward push on rear rod extensions 130, 134 which push on pushing rods 70', 72'. In embodiments, lever 96 may be spring-loaded with a tension spring 85 attached to lever 96 toward a top of lever 96 such that when the top of lever 96 is rotated forward when trigger 20 is activated, spring 85 is extended and when trigger 20 is released, spring 85 retracts the top of lever 96 backward.

In FIG. 18(*a*), upper pushing rod 70', which is radially aligned with the outer concentric ring 62 on drum 60, and is directly aligned at that moment with a first projectile holder 61*a* of projectile holders 61 in the outer concentric ring 62, engages a dart 63 that is loaded in the outer concentric ring 62 and pushes dart 63 forward out of drum 60 into engagement with motorized flywheels 110*a*, 110*b*. The rotating flywheels 110*a*, 110*b*, in turn, contact an outer surface of dart 63, and propel the dart forward (FIG. 18(*b*)) and out of launcher 128 (FIG. 18(*c*)). When pushing rod 70' moves forward through respective opening 66 in the back of drum 60 to advance a dart, rack or notches 130N on rear rod extension 130 cause pinion gear 138 to rotate counterclockwise, as viewed from the vantage point shown in FIG. 18(*a*).

At the same time that the upper pushing rod 70' is pushing the dart 63 out of drum 60, pushing rod 72', which is radially aligned with inner concentric ring 64 of projectile holders 61, is also pushed forward by the plate/bracket 98 to be launched. However, because inner concentric ring 64 is angularly offset from outer concentric ring 62, the path of pushing rod 72' is blocked by a divider 123 (see FIG. 5) that separates adjacent projectile holders in the inner concentric ring 64 of drum 60. Thus, pushing rod 72' corresponding to inner concentric ring 64 does not advance into any projectile holder 61 in drum 60 at that time and pushing rod 72', corresponding to inner concentric ring 64, does not advance into any projectile holder 61 in drum 60 at that time. Consequently, only one dart is launched at that moment from launcher 128. The blockage of pushing rod 72', coupled with the counterclockwise rotation of pinion gear 138, causes the outer casing that includes back wall 94 to move forward with pinion gear 138 mounted therein in relation to lower pushing rod 72', as seen in FIG. 18(*a*). Sufficient space should be provided to allow for the outer casing to move forward in relation to the blocked pushing rod 72'.

Referring again to FIG. 18(*c*), after each dart 63 is launched, plate/bracket 98 retracts (pulled by spring 99 returning to its rest position) and both pinion gear-loaded pushing rods 70', 72' return to their rest state. Pawl 74 also returns to its rest state, pulled by spring 103. Additionally, in embodiments in which tension spring 85 is attached toward a top of lever 96, spring 85 is released from its extended position.

Figure 19A:
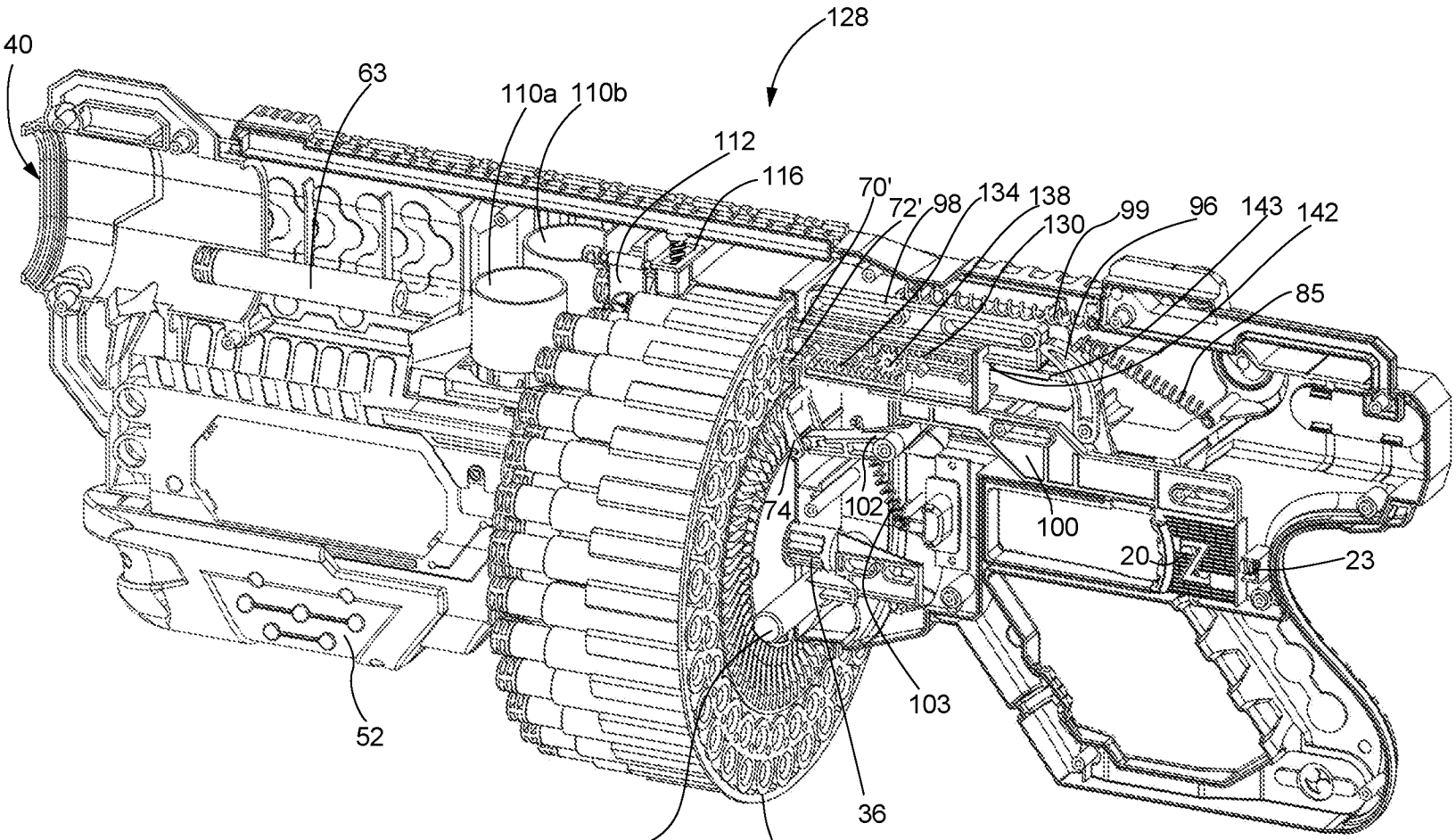
FIG. 19(*a*) shows a cutaway view of the toy dart launcher in perspective where the trigger has been activated in accordance with the second embodiment of the present invention to launch another toy dart from a projectile holder from an adjacent projectile holder in an inner concentric ring on the drum.
Figure 19B:
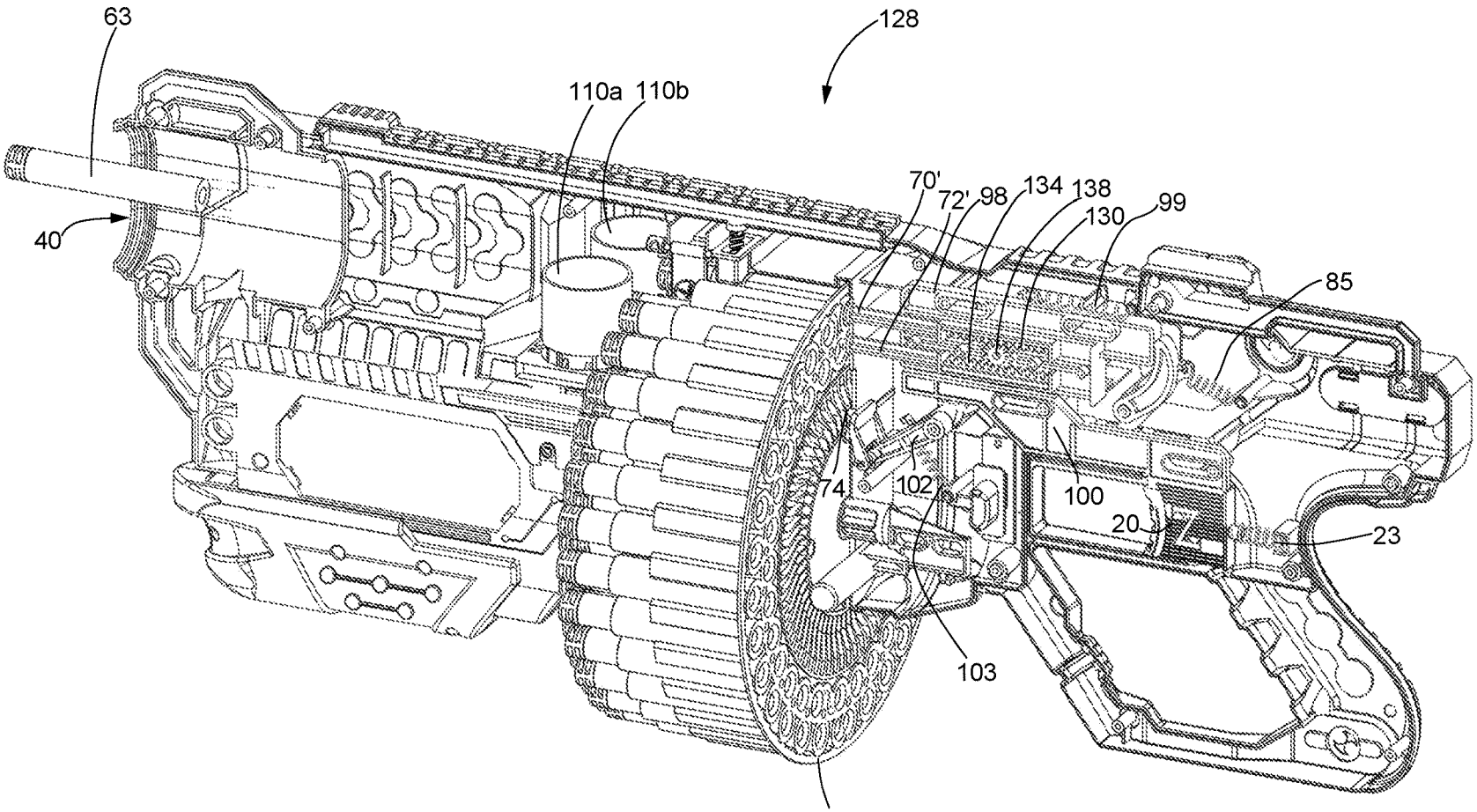

Referring to FIGS. 19(*a*) and 19(*b*), upon a next activation of trigger 20, drum 60 again rotates by a single angular increment as pawl 74, engages a respective groove 80 on drum 60, and moves upward through a groove 80. Then, plate/bracket 98 slides forward with a push from lever 96, thereby applying a forward push on rear rod extensions 130, 134 which push on pushing rods 70', 72'. In FIG. 19(*a*), the second, lower pushing rod 72', which is radially aligned with the inner concentric ring 64 on drum 60 and is directly aligned at that moment with a first projectile holder 61*b* of projectile holders 61 in the inner concentric ring 64, engages a dart 63 that is loaded in the inner concentric ring 64 and pushes dart 63 forward out of drum 60 and toward and into engagement with motorized flywheels 110*a*, 110*b*. The rotating flywheels 110*a*, 110*b*, in turn, contact an outer surface of dart 63, and propel the dart forward (FIG. 19(*b*)) and out of launcher 128. When pushing rod 72' moves forward through respective opening 66 in the back of drum 60 to advance a dart, notches 134N on rear rod extension 134 cause gear 138 to rotate clockwise, as viewed from the vantage point shown in FIG. 19(*a*).

At the same time that the lower pushing rod 72' is pushing the dart 63 out of drum 60, the first, upper pushing rod 70', which is radially aligned with outer concentric ring 62 of projectile holders 61, is also pushed forward by the plate/bracket 98 to be launched. However, because outer concentric ring 62 is angularly offset from inner concentric ring 64, the path of pushing rod 70' is blocked by divider 124, as shown in FIG. 5, that separates adjacent projectile holders 61 in the outer concentric ring 62 of drum 60. Thus, pushing rod 70', corresponding to outer concentric ring 62, does not advance into any projectile holder 61 in drum 60 at that time. Therefore, only one dart is launched at that moment with no dart being launched via movement of pushing rod 70'. The blockage of pushing rod 70', coupled with the clockwise rotation of gear 138, causes upper pushing rod 70' to be pushed backward as seen in FIG. 19(*a*). Sufficient space should be provided to allow for the blocked pushing rod 70' to move backward as displaced by the rotation of gear 138. In embodiments, the backward movement of the blocked pushing rod may be limited by a stop (not shown).

Referring again to FIG. 18(*c*), after each dart 63 is launched, plate/bracket 98 retracts (pulled by spring 99 returning to its rest position) and both pinion gear-loaded pushing rods 70', 72' return to their rest state. Pawl 74 also returns to its rest state, pulled by spring 103. Additionally, in embodiments in which tension spring 85 is attached toward a top of lever 96, spring 85 is released from its extended position.

When trigger 20 is next activated, drum 60 again advances a groove 80 and launches a third dart 63 from outer concentric ring 62. The process repeats, launching darts alternatively from a first concentric ring, than from a second concentric ring, then from the first concentric ring, then from the second concentric ring, etc. When all or at least some of the darts are fired, a user may reload any vacant projectile holders 61 in drum 60 with one or more darts.

It will be understood that, when the trigger on launcher 1 or launcher 128 is activated, the angular position of drum 60 determines which dart will be launched and from which concentric ring the dart is to be launched. Thus, launching of darts may begin with the launching of a dart from the outer concentric ring or the inner concentric ring. In the above example, the launching of darts is described as beginning with the launching of a dart from the outer concentric ring; however, this is a non-limiting example. Instead, the launching of darts may begin with the launching of a dart from the inner concentric ring.

Thus, the configuration of launcher 1 or launcher 128 in accordance with the present invention allows for inclusion of many darts on the drum and for a simplified launcher construction.

While launcher 1 or launcher 128 described above has a drum with two concentric rings of projectile holders and two pushing rods, in embodiments, a launcher may have a drum that has more than two concentric rings of projectile holders, with projectile holders in the third concentric ring offset angularly from projectile holders in the other rings. For example, a drum may have three concentric rings of projectile holders/cylinders. In that case, a third pushing rod may be provided in the launcher to push projectiles of the third concentric ring on the drum. The launcher would then be configured to include either longer flywheels or multiple flywheels to propel projectiles loaded in the additional concentric ring(s).

Moreover, while launcher 1 or launcher 128 is described above as launching only one dart at a time, in embodiments, launcher 1 or launcher 128 may be configured to launch multiple projectiles simultaneously from one or both concentric rings 62, 64. For example, one or more pushing rods may be added (in addition to pushing rods 70, 72 or 70', 72') for pushing more than one projectile simultaneously from the first concentric ring of the drum and one or more pushing rods may be added for pushing more than one projectile simultaneously from the second concentric ring of the drum. In these embodiments, the shape of grooves 80 on the drum may have to be adjusted to increase the size of the incremental rotation of the drum to account for the simultaneous launching of multiple projectiles from each concentric ring of the drum.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A toy launcher for launching projectiles, comprising:

(a) a drum having a substantially circular shape and comprising two or more concentric rings of projectile holders to hold projectiles for launching, the drum comprising a first of the two or more concentric rings located substantially at a first radius from the center of the drum and a second of the two or more concentric rings located substantially at a second radius from the center of the drum, wherein the second radius is different than the first radius, (1) wherein adjacent projectile holders within each of the first second concentric rings are each separated from one another by a respective divider; and (2) wherein the respective projectile holders in the first concentric ring are angularly offset from the respective projectile holders in the second concentric ring; and (b) one or more flywheels positioned in front of a first side of the drum that are adapted to propel at least one of the projectiles when pushed from the drum toward the one or more flywheels for launching the at least one of the projectiles out of the toy launcher.

2. The toy launcher of claim 1, further comprising:

(c) a projectile advancement assembly to push the projectiles from the projectile holders of the drum one at a time toward the one or more flywheels to launch the projectiles, (1) wherein the projectile advancement assembly comprises a first pushing rod that is positioned so as to be aligned with the projectile holders in the first concentric ring and adapted to push at least one of the projectiles from the projectile holders of the first concentric ring and a second pushing rod that is positioned so as to be aligned with the second projectile holders in the second concentric ring and adapted to push at least one of the projectiles from the projectile holders of the second concentric ring; and (2) wherein the projectile advancement assembly is adapted to substantially simultaneously push both the first and second pushing rods each time that the projectile advancement assembly is engaged.

3. The toy launcher of claim 2, further comprising:

(d) a trigger that, upon activation, causes an incremental rotation of the drum and engages the projectile advancement assembly to push the plurality of pushing rods forward substantially simultaneously toward the drum such that the first pushing rod that is in alignment with a respective one of the projectile holders in the first concentric ring is adapted to mechanically push a first of the projectiles, when loaded, in the respective one of the projectile holders to engage with at least one of the one or more flywheels to launch the first projectile, while the second pushing rod that is in alignment with the second concentric ring is blocked by the respective divider that separates the adjacent projectile holders in the second concentric ring from pushing a second of the projectiles substantially simultaneously with the launch of the first of the projectiles.

4. The toy launcher of claim 2, wherein the first and second pushing rods are spring-loaded.

5. The toy launcher of claim 2, wherein the projectile advancement assembly further comprises a pinion gear that freely rotates about a fixed position; and wherein each of the first and second pushing rods comprises a respective rack that engages with the pinion gear so that a forward movement of one pushing rod of the first and second pushing rods causes a backward movement of the other pushing rod of the first and second pushing rods.

6. The toy launcher of claim 5, wherein the projectile advancement assembly is adapted such that a push of one of the first and second pushing rods into an aligned projectile holder in one of the first and second concentric rings of the drum causes the pinion gear to rotate and cause a force on the other of the first and second pushing rods to move backwards away from the drum.

7. The toy launcher of claim 2, wherein the drum comprises a second side comprising a plurality of openings to the projectile holders corresponding to each of the plurality of projectile holders in the first and second concentric rings wherein the plurality of openings are sized to allow a first of the plurality of pushing rods to fit through each the plurality of openings in the first concentric ring, and to allow a second of the plurality of pushing rods to fit through each of the plurality of openings in the second concentric ring.

8. The toy launcher of claim 7, wherein the drum further comprises on the second side of the drum a plurality of non-linear grooves with each groove corresponding to a different one of the plurality of projectile holders in each of the first and second concentric rings, and wherein the toy launcher further comprises a pawl that is adapted to glide through each of the plurality of non-linear grooves to rotate the drum incrementally upon gliding through one of the plurality of non-linear grooves.

9. The toy launcher of claim 2, wherein the projectile advancement assembly further comprises a mounting plate or bracket coupled to the first and second pushing rods.

10. The toy launcher of claim 1, wherein the projectiles are toy darts.

11. The toy launcher of claim 1, wherein the projectiles are toy balls.

12. The toy launcher of claim 1, wherein the drum is removable from the toy launcher.

13. The toy launcher of claim 1, wherein the drum is non-removable from the toy launcher.

14. The toy launcher of claim 1, wherein the drum is rotatable within the toy launcher such that each of the projectile holders in both the first and second concentric rings is positionable to allow the projectiles to be launched one at a time in a sequence starting with a first launch of a first of the projectiles from a respective projectile holder in the first concentric ring, and then a second launch of a second of the projectiles from an adjacent one of the respective projectile holders in the second concentric ring.

15. The toy launcher of claim 1, wherein at least one of the one or more flywheels are motorized and are positioned adjacent the drum so as to engage with the respective projectile when the respective projectile is pushed out of the drum.

16. The toy launcher of claim 1, wherein the one or more flywheels comprise at least one elongated flywheel that extends in length adjacent both the first and second concentric rings of projectile holders.

17. The toy launcher of claim 1, wherein the projectile holders are substantially equally spaced apart from one another.

18. The toy launcher of claim 1, wherein the plurality of projectile holders are adapted to hold toy darts.

19. The toy launcher of claim 1, wherein the projectile holders are of substantially equal dimensions.

20. A toy launcher for launching projectiles, comprising:

(a) a drum having a substantially circular shape and comprising two or more concentric rings of projectile holders to hold projectiles for launching, the drum comprising a first of the two or more concentric rings located substantially at a first radius from the center of the drum and a second of the two or more concentric rings located substantially at a second radius from the center of the drum, wherein the second radius is different than the first radius, and wherein adjacent projectile holders within each of the first second concentric rings are each separated from one another by a respective divider;

(b) a projectile advancement assembly to push the projectiles from the projectile holders of the drum one at a time to launch the projectiles, (1) wherein the projectile advancement assembly comprises a first pushing rod that is positioned so as to be aligned with the projectile holders in the first concentric ring and adapted to push at least one of the projectiles from the projectile holders of the first concentric ring and a second pushing rod that is positioned so as to be aligned with the second projectile holders in the second concentric ring and adapted to push at least one of the projectiles from the projectile holders of the second concentric ring; and (2) wherein the projectile advancement assembly is adapted to substantially simultaneously push both the first and second pushing rods each time that the projectile advancement assembly is engaged; and (c) a trigger that, upon activation, causes an incremental rotation of the drum and engages the projectile advancement assembly to push the plurality of pushing rods forward substantially simultaneously toward the drum such that the first pushing rod that is in alignment with a respective one of the projectile holders in the first concentric ring is adapted to mechanically push a first of the projectiles, when loaded, in the respective one of the projectile holders to launch the first projectile, while the second pushing rod that is in alignment with the second concentric ring is blocked by the respective divider that separates the adjacent projectile holders in the second concentric ring from pushing a second of the projectiles substantially simultaneously with the launch of the first of the projectiles.

21. The toy launcher of claim 20, wherein the first and second pushing rods are spring-loaded.

22. The toy launcher of claim 20, wherein the respective projectile holders in the first concentric ring are angularly offset from the respective projectile holders in the second concentric ring.

23. A toy launcher for launching projectiles, comprising:

(a) a drum having a substantially circular shape and comprising two or more concentric rings of projectile holders to hold projectiles for launching, the drum comprising a first of the two or more concentric rings located substantailly at a first radius from the center of the drum and a second of the two or more concentric rings located substantially at a second radius from the center of the drum, wherein the second radius is different that the first radius, and wherein adjacent projectile holders within each of the first second concentric rings are each separated from one another by a respective divider;

(b) a projectile advancement assembly to push the projectiles from the projectile holders of the drum one at a time to launch the projectiles, wherein the projectile advancement assembly comprises;

a first pushing rod that is positioned so as to be aligned with the projectile holders in the first concnetric rings and adapted to push at least one of the projectiles from the projectile holders of the first concentric ring;

a second pushign rod that is positioned so as to be aligned with the second projectile holders in the second concentric ring and adapted to push at least one of the projectiles from the projectile holders of the second concentric ring, and a pinion gear that freely rotates about a fixed position of the projectile advancement assembly, and (c) a trigger that upon activation, causes an incremental rotation of the drum and engages the projectile advancement assebly to push one of the plurality of pushing rods forward such that the first pushing rod that is in alignment with a respective one of the projectile holders in the first concentric ring is adapted to mechanically push a first of the projectiles, when loaded, in the respective one of the projectile holders to launch the first projectile, while the second pushing rod that is in alignment with the second concentric ring is blocked by the respective divider that separates the adjacent projectile holders in teh second concentric ring from pushign a second of the projectiles substantially simultaneously with the launch of the first of the prjectiles, whrein each of the first and second pushing rods comprises a respective rack that engages with the pinion gear so that a forward movement of one pushing rod of the first and second pushing rods causes the pinion gear to rotate.

24. The toy launcher of claim 23, wherein the projectile advancement assembly is adapted such that a push of one of the first and second pushing rods into an aligned projectile holder in one of the first and second concentric rings of the drum causes the pinion gear to rotate forward along the respective rack on the other of the first and second pushing rods.

* * * * *